US012350542B1

(12) United States Patent
Nayak et al.

(10) Patent No.: US 12,350,542 B1
(45) Date of Patent: Jul. 8, 2025

(54) EXERCISE DEVICE

(71) Applicant: Podium Fit, Inc., San Francisco, CA (US)

(72) Inventors: Subrat Nayak, San Francisco, CA (US); Erik Aylen, Bozeman, MT (US); Adam Ellison, Fitzroy North (AU)

(73) Assignee: Podium Fit, Inc., San Francisco, CA (US)

( * ) Notice: Subject to any disclaimer, the term of this patent is extended or adjusted under 35 U.S.C. 154(b) by 365 days.

(21) Appl. No.: 17/693,343

(22) Filed: Mar. 12, 2022

Related U.S. Application Data

(60) Provisional application No. 63/160,399, filed on Mar. 12, 2021.

(51) Int. Cl.
*A63B 21/00* (2006.01)
*A63B 21/005* (2006.01)
*A63B 24/00* (2006.01)

(52) U.S. Cl.
CPC ..... *A63B 21/153* (2013.01); *A63B 21/0058* (2013.01); *A63B 21/4033* (2015.10); *A63B 24/0062* (2013.01); *A63B 2024/0096* (2013.01); *A63B 2220/13* (2013.01); *A63B 2220/20* (2013.01); *A63B 2220/833* (2013.01)

(58) Field of Classification Search
CPC ..... A63B 21/153; A63B 21/0058; A63B 21/4033; A63B 24/0062; A63B 2024/0096; A63B 2220/13; A63B 2220/20; A63B 2220/833; A63B 21/4035;
(Continued)

(56) References Cited

U.S. PATENT DOCUMENTS 5,645,513 A 7/1997 Haydocy et al.
5,888,172 A 3/1999 Andrus et al.
(Continued)

FOREIGN PATENT DOCUMENTS

WO WO-2022212737 A1 10/2022
WO WO-2022227499 A1 11/2022
(Continued)

OTHER PUBLICATIONS

Toro, David, "Introduction to Brushless DC Motors" [online], May 2021 [retrieved on Oct. 15, 2024], Diodes Incorporated, Retrieved from: https://www.diodes.com/assets/Uploads/AN1164-BLDC-Motors.pdf (Year: 2021).*
(Continued)

*Primary Examiner* — Joshua Lee
*Assistant Examiner* — Catrina A Letterman
(74) *Attorney, Agent, or Firm* — Schwegman Lundberg & Woessner, P.A.

(57) ABSTRACT

A dynamic cable-actuated resistance training device comprises a base having first and second side pods at opposite ends of the base. A first motor is located in the first side pod and a first cable guide is located in the second side pod, with a first cable passing between the first motor and the first cable guide and being attachable to a workout handle or bar. A second motor is also located in the second side pod and a second cable guide is also located in the first side pod, with a second cable passing between the second motor and the second cable guide and being attachable to a workout handle or bar.

20 Claims, 27 Drawing Sheets

(58) Field of Classification Search
CPC .... A63B 2208/0204; A63B 2024/0093; A63B 24/0087; A63B 21/156; A63B 23/0458
See application file for complete search history.

(56) References Cited

U.S. PATENT DOCUMENTS

| | | | | |
|---|---|---|---|---|
| 7,556,590 | B2 | 7/2009 | Watterson et al. | |
| 7,648,446 | B2 | 1/2010 | Chiles et al. | |
| 8,900,099 | B1 | 12/2014 | Boyette | |
| 9,539,458 | B1 | 1/2017 | Ross | |
| 2002/0055424 | A1 | 5/2002 | Brown | |
| 2006/0269251 | A1 | 11/2006 | Hsu | |
| 2008/0051256 | A1 | 2/2008 | Ashby et al. | |
| 2008/0153670 | A1 | 6/2008 | Mckirdy et al. | |
| 2010/0048356 | A1 | 2/2010 | Hamilton | |
| 2010/0069202 | A1 | 3/2010 | Olsen | |
| 2010/0234184 | A1 | 9/2010 | Le et al. | |
| 2011/0082006 | A1 | 4/2011 | Ishii et al. | |
| 2011/0165995 | A1 | 7/2011 | Paulus et al. | |
| 2011/0251021 | A1 | 10/2011 | Zavadsky et al. | |
| 2014/0194250 | A1 | 7/2014 | Reich et al. | |
| 2014/0194251 | A1 | 7/2014 | Reich et al. | |
| 2015/0080184 | A1 | 3/2015 | Boyette | |
| 2016/0256745 | A1 | 9/2016 | Brammer | |
| 2016/0332019 | A1 | 11/2016 | Rollins | |
| 2018/0021616 | A1 | 1/2018 | Orady et al. | |
| 2018/0214729 | A1* | 8/2018 | Rubin | A63B 24/0087 |
| 2019/0076691 | A1 | 3/2019 | Smith | |
| 2020/0047030 | A1 | 2/2020 | Ward et al. | |
| 2020/0047031 | A1 | 2/2020 | Orady et al. | |
| 2020/0261771 | A1 | 8/2020 | Belson et al. | |
| 2020/0276465 | A1 | 9/2020 | Orady et al. | |
| 2020/0298049 | A1 | 9/2020 | Valente et al. | |
| 2020/0316424 | A1 | 10/2020 | Orady et al. | |
| 2020/0330847 | A1 | 10/2020 | Orady et al. | |
| 2021/0069553 | A1 | 3/2021 | Belson et al. | |
| 2021/0111646 | A1 | 4/2021 | Rubin | |
| 2021/0128978 | A1 | 5/2021 | Gilstrom et al. | |
| 2021/0170212 | A1 | 6/2021 | Lafrance et al. | |
| 2021/0170213 | A1 | 6/2021 | Orady et al. | |
| 2021/0170214 | A1 | 6/2021 | Orady et al. | |
| 2021/0236876 | A1* | 8/2021 | Gregory | A63B 21/4029 |
| 2021/0291021 | A1 | 9/2021 | Orady et al. | |
| 2021/0379436 | A1 | 12/2021 | Orady et al. | |
| 2021/0394011 | A1* | 12/2021 | Neuhaus | A63B 21/151 |
| 2021/0394023 | A1 | 12/2021 | Belson et al. | |
| 2022/0001240 | A1 | 1/2022 | Rubin et al. | |
| 2022/0032114 | A1 | 2/2022 | Valente et al. | |
| 2022/0184452 | A1* | 6/2022 | Valente | A63B 21/4029 |
| 2023/0149762 | A1 | 5/2023 | Willison et al. | |
| 2023/0201652 | A1* | 6/2023 | Ye | A63B 23/03541 482/133 |
| 2023/0405404 | A1* | 12/2023 | Belsham | A63B 21/0058 |
| 2024/0189651 | A1* | 6/2024 | Drayer | A63B 23/03516 |

FOREIGN PATENT DOCUMENTS

| | | | |
|---|---|---|---|
| WO | WO-2023069724 | A1 | 4/2023 |
| WO | WO-2023102016 | A1 | 6/2023 |

OTHER PUBLICATIONS

U.S. Appl. No. 18/212,681, filed Jun. 21, 2023, Exercise Device With Force Sensors to Estimate Foot Position.
U.S. Appl. No. 18/212,683, filed Jun. 21, 2023, Exercise Device Cable Safety Locking Mechanism.
"Science—Speede Fitness", https://speede.fit/pages/science.
"Speede—Frequently Asked Questions", https://speede.fit/pages/faq.
"Speediance Works", https://www.speediance.com/confirm?id=2.
U.S. Appl. No. 17/866,235, Non Final Office Action mailed Oct. 25, 2024, 17 pgs.

* cited by examiner

| Angle (deg) | Cosine |
|---|---|
| 0 | 1.000 |
| 5 | 0.996 |
| 10 | 0.985 |
| 15 | 0.966 |
| 20 | 0.940 |
| 25 | 0.906 |
| 30 | 0.866 |
| 35 | 0.819 |
| 40 | 0.766 |
| 45 | 0.707 |
| 50 | 0.643 |
| 55 | 0.574 |
| 60 | 0.500 |
| 65 | 0.423 |
| 70 | 0.342 |
| 75 | 0.259 |
| 80 | 0.174 |
| 85 | 0.087 |
| 90 | 0.000 |

EXERCISE DEVICE

RELATED APPLICATION DATA

This application claims the benefit of priority under 35 U.S.C. § 119(e) of U.S. Provisional Patent Application Ser. No. 63/160,399, filed on Mar. 12, 2021, which is incorporated by reference herein in its entirety as if expressly set forth.

TECHNICAL FIELD

This patent application generally relates to the field of exercise equipment. More specifically, this patent application relates to a dynamic cable-actuated resistance training device that mimics traditional free weights in usage.

BACKGROUND

Exercise is known to be a big enabler of physical and mental well-being. Resistance training, also known as strength or weight training, has significant health benefits, but can also be challenging for a typical person to do correctly or well. Exercising the whole body is good for overall wellbeing, rather than just exercising a few isolated muscles. Compound exercises that engage multiple muscle groups are the most beneficial and time-efficient exercises. Resistance training can also be used for cardiovascular training when done with relatively lower resistance at relatively higher reps over a relatively longer period of time.

There are many known types of exercise equipment for doing cardiovascular training in an indoor setting such as treadmills, stationary spin bikes, rowing machines, stair climbers etc. that have some sort of mechanism to vary the resistance mechanically or magnetically or electro-magnetically.

Resistance training is typically performed by doing body-weight exercises, using free weights, using resistance stretch bands, or using weight-training machines with weights driven through stabilized rigid linkages, or cable machines with weights driven through cables and pulleys, but these suffer from various disadvantages. For body-weight exercises, the resistance doesn't always match the strength of the muscles being engaged. Working with free weights can be potentially hurtful, damaging to the surrounding environment, noisy, or require heavy and expensive safety equipment. Cable machines and weight-training machines require a significant amount of space. While one cable machine can do many different exercise, weight-training machines are usually made for a specific exercise requiring a significant number of different devices to provide a full body workout. Stabilization inherent in weight-training machines can prevent the engagement of all the muscle groups need to stabilize movements under load in real life activities. Resistance stretch bands usually act as linear springs, in which the force increases with extension, so the force is not freely and fully controllable. Some magnetic and flywheel mechanisms exist that can vary the resistance to some extent, but the resistance usually increases with increase in speed of the movement and is thus not sufficiently controllable.

There has been growing interest in exercising at home, instead of commuting to the gym and sharing equipment. Exercise equipment made for the home needs to be affordable, quiet, time-efficient, light weight, portable and space-efficient. It can however be a challenge to stay consistent enough to reap the health benefits. Users can be kept motivated through various digital methods like content and feedback on a digital screen, data logging, progress tracking, live group classes, video communication with a coach and/or other users.

BRIEF DESCRIPTION OF THE SEVERAL VIEWS OF THE DRAWINGS

Some examples of the present disclosure are illustrated by way of example and not limitation in the figures of the accompanying drawings, in which like reference numbers indicate similar elements. To easily identify the discussion of any particular element or act, the most significant digit or digits in a reference number refer to the figure number in which that element is first introduced.

DETAILED DESCRIPTION

Figure 1:
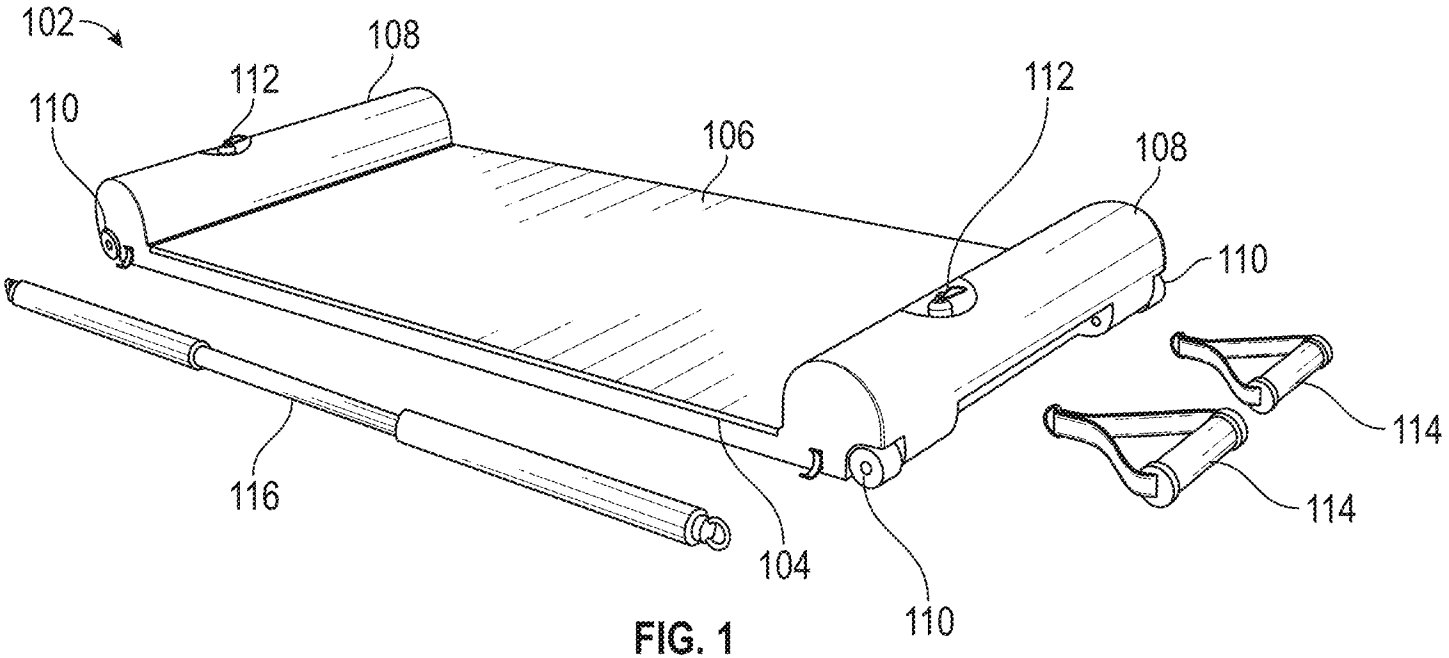
FIG. 1 is a perspective view of an exercise device, according to some examples.

FIG. 1 is a perspective view of an exercise device 102 according to some examples. The exercise device 102 includes a base comprising a chassis 104 and a platform 106, spaced-apart left and right side pods 108, wheels 110, and attachment points 112 to which a workout element, such as handles 114 or a bar 116, can be attached for use in resistance training. The exercise device 102 will typically be placed on the ground, although it can be mounted to the wall or another structure. As will be described in more detail below, the attachment points 112 are coupled to two cables 202 that are housed in the side pods 108.

Figure 3A:
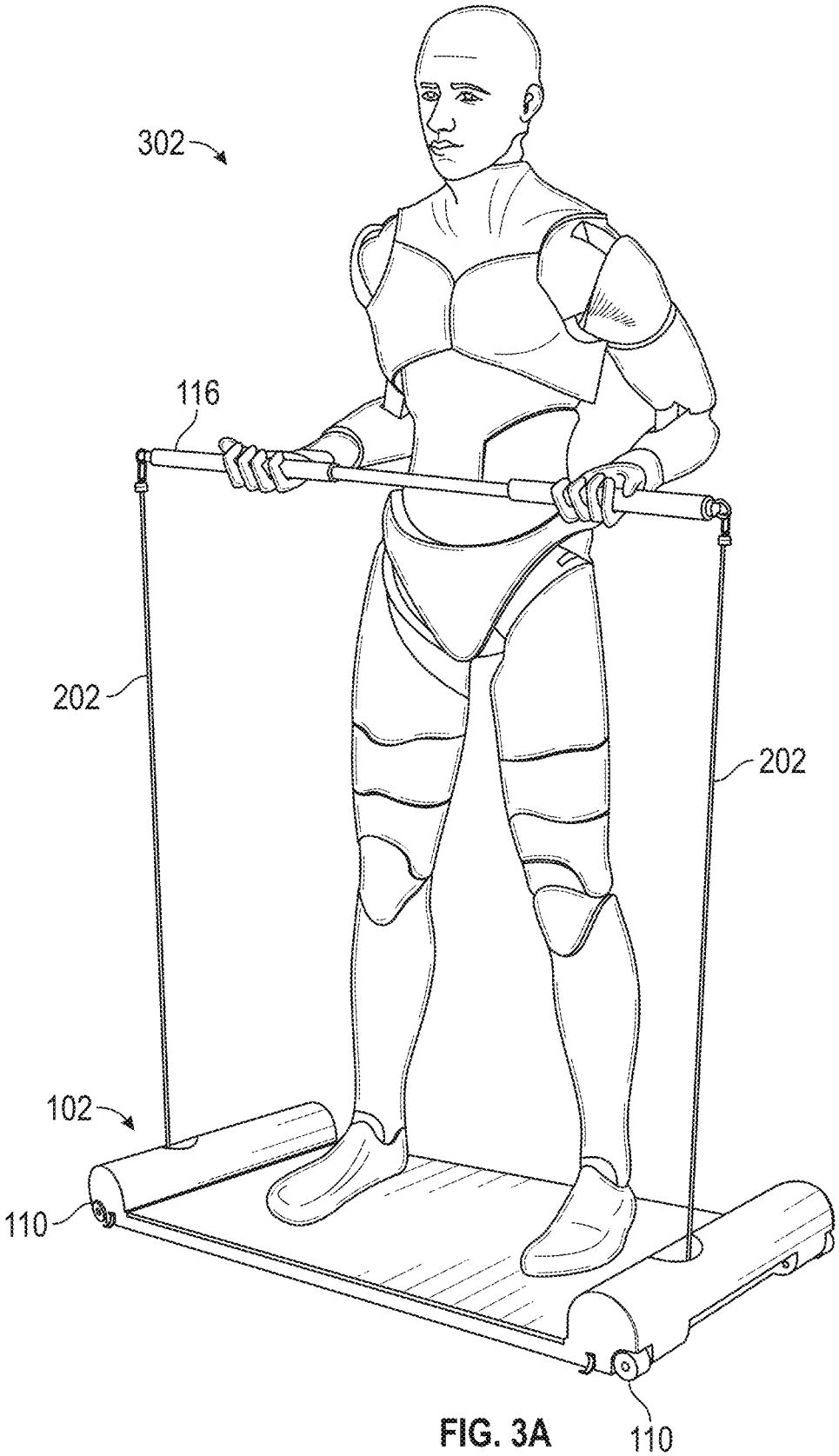
FIG. 3A, FIG. 3B and FIG. 3C illustrate strength exercises that can be performed using the exercise device according to some examples.
Figure 3B:
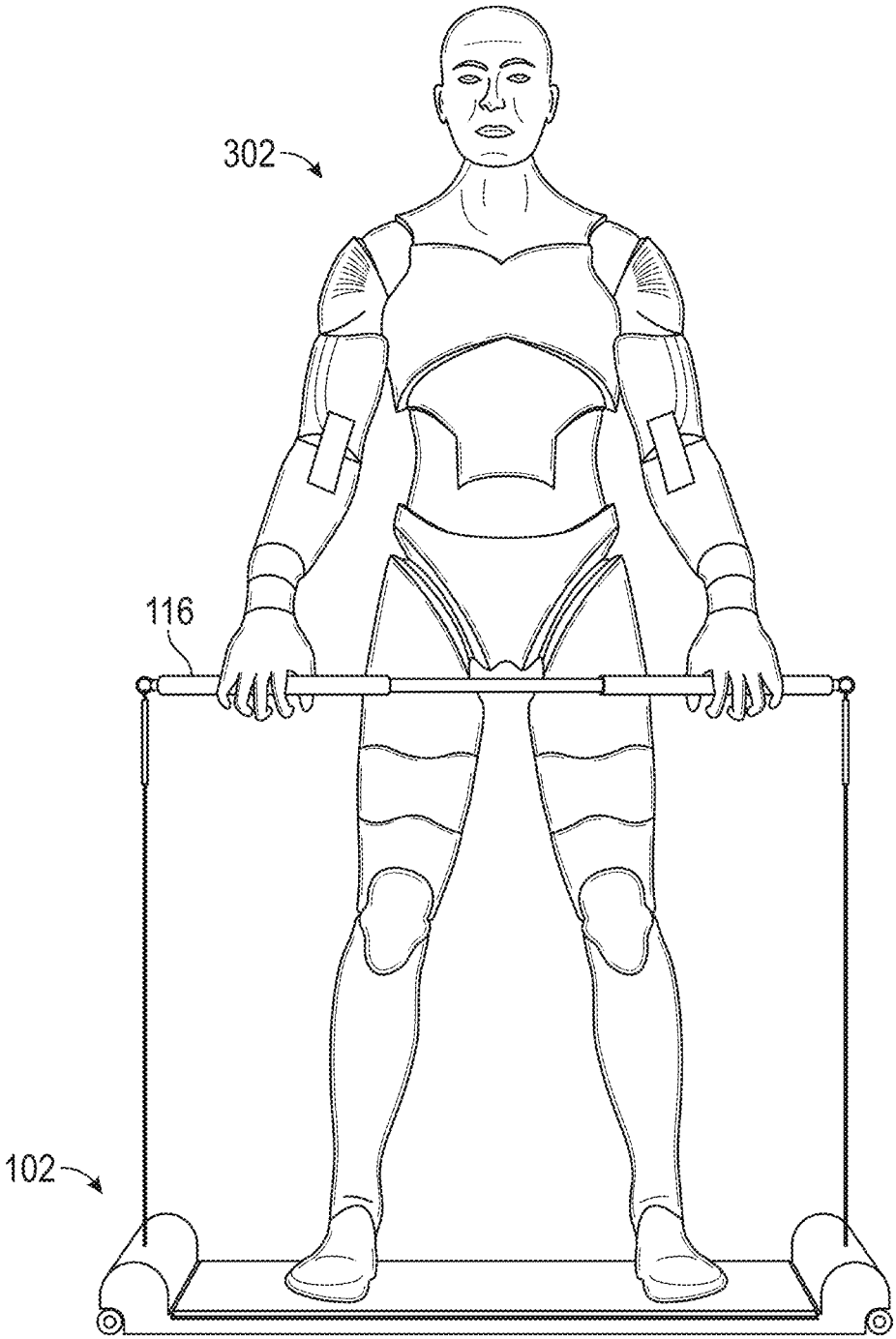
Figure 3C:
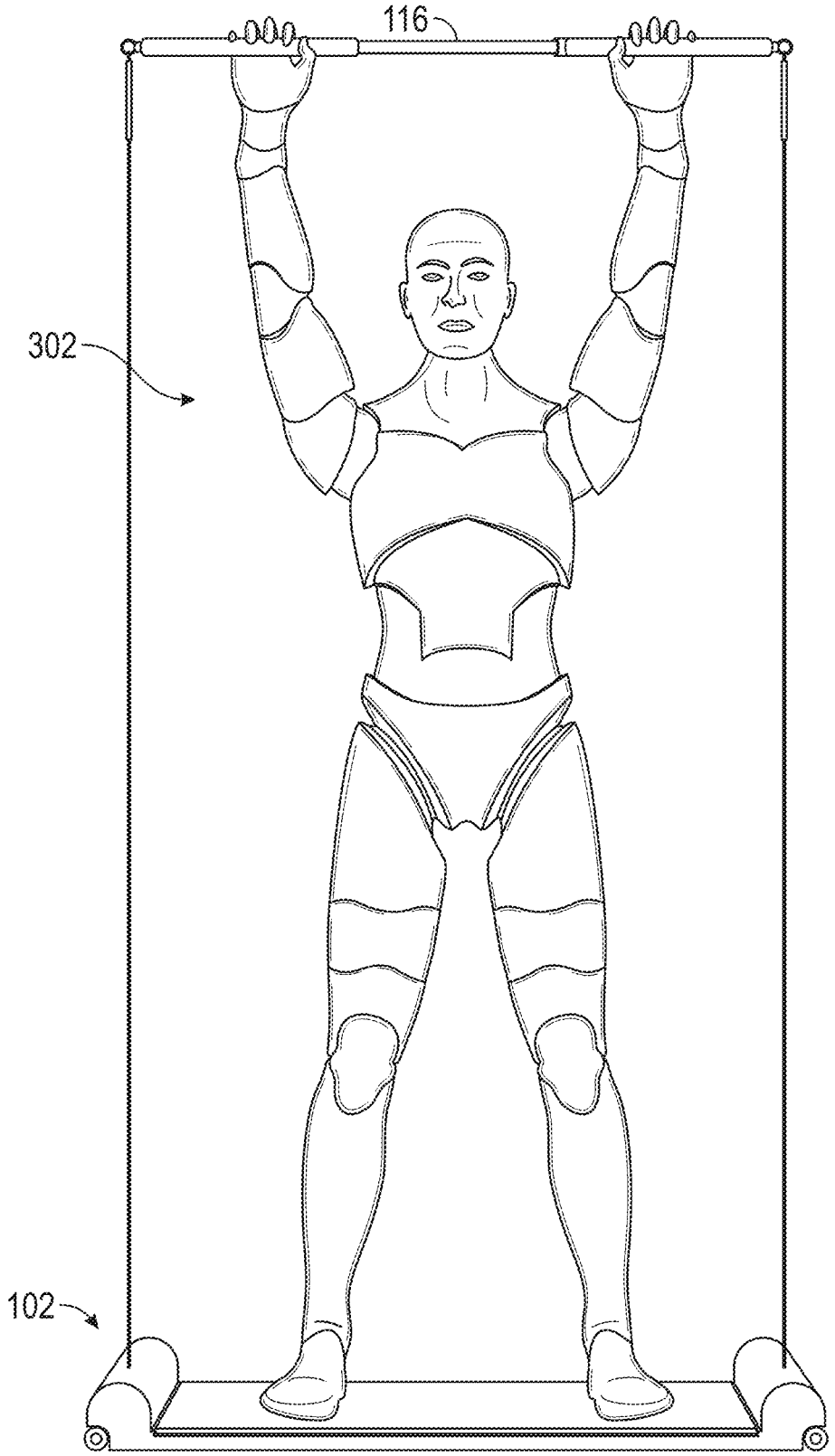

The top of the platform 106 is planar and fairly low in height (in the range of 2-3 inches) when the exercise device 102 is on the ground, which mitigates any risk or fear of falling off of a high step during exercise and makes the exercise device 102 safer. A user can stand, sit, kneel, or lie on the platform 106 depending on the exercise, with the user's weight holding the exercise device 102 down while the user lifts in an upward direction using the bar 116 or the handles 114 as shown in FIG. 3A, FIG. 3B and FIG. 3C. Additionally, since the bar 116 overlaps the side pods 108 on both sides, if a user drops the bar 116 it will hit the side pods 108 before it hits the user's feet.

The chassis 104 is supported by wheels 110. There may be two wheels 110 on just one side so that the exercise device 102 can be picked up from the other side to engage the wheels 110, which permits the exercise device 102 to be moved into and out of storage like a rolling suitcase, without having to lift the full weight of the exercise device 102. In other examples, the device may have four wheels 110 (two on each side as shown in FIG. 1). In some cases, the wheels do not extend below the bottom of the chassis 104 and require that a side of the exercise device 102 be lifted up on one side to engage the wheels on another side.

In other examples, the wheels 110 are spring-loaded and protrude below the chassis 104 when the exercise device 102 is not in use, but are pushed up into the chassis 104 when a certain minimum weight of the user rests on the platform 106, which ensures that the exercise device 102 is securely engaged with the ground when used. This provision of wheels 110 permits the exercise device 102 to be rolled away conveniently, for storage under a bed or couch for example.

In the case of spring-loaded wheels 110, one or more of the wheels 110 may be attached to a sensor to detect whether it or they are pushed up into the chassis by the user's weight. Detection of these two states of the wheels 110 may be used to enable full functioning of the exercise device 102 when the wheels are retracted and to disable full functioning of the exercise device 102 when the wheels are extended. In particular, the exercise device 102 can use these two states to disable tension in the cables provided by the motors 612 (see FIG. 6) when the user's weight is not on the platform, so that if the user steps off the platform 106 during an exercise or is not on the platform when a handle 114 or the bar 116 is lifted, the platform 106 will not be lifted into the air under the power of the motors. Alternatively, sensors could be provided in the platform 106 or elsewhere to detect the user's weight, to enable or disable functioning of at least the motors 612 based on detecting the presence or absence of the user's weight.

In other examples, the wheels 110 on one or both of the sides may be casters, or there may be a single caster wheel on one side and two normal wheels on the other side. Providing at least one caster wheel allows the user to rotate the exercise device 102 while on the ground, which helps in moving the exercise device 102 under beds and couches that may have little clearance under them.

Figure 2A:
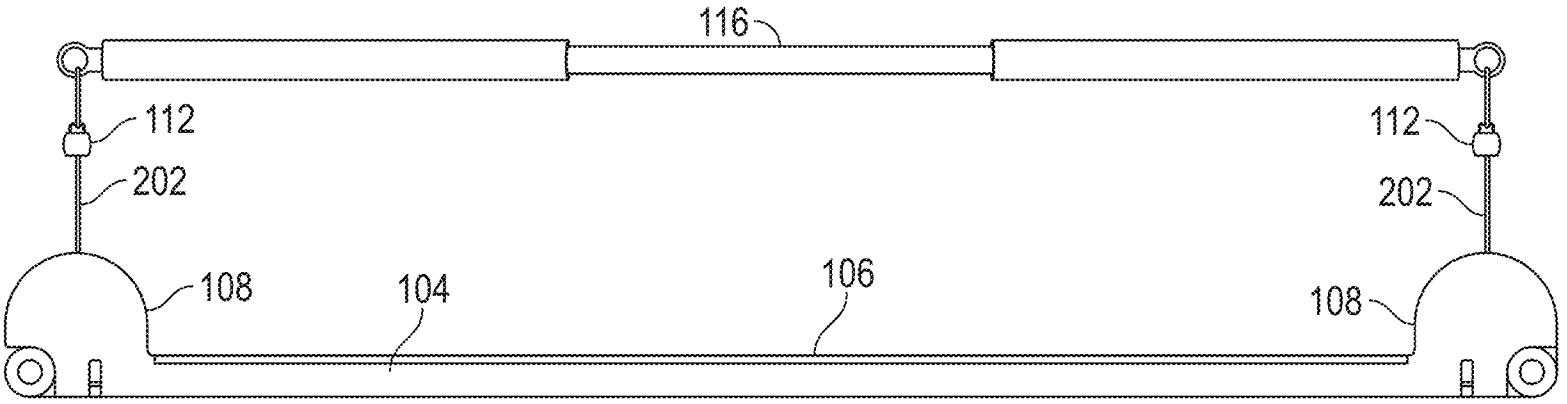
FIG. 2A and FIG. 2B show two configurations of the exercise device in use, according to some examples.
Figure 2B:
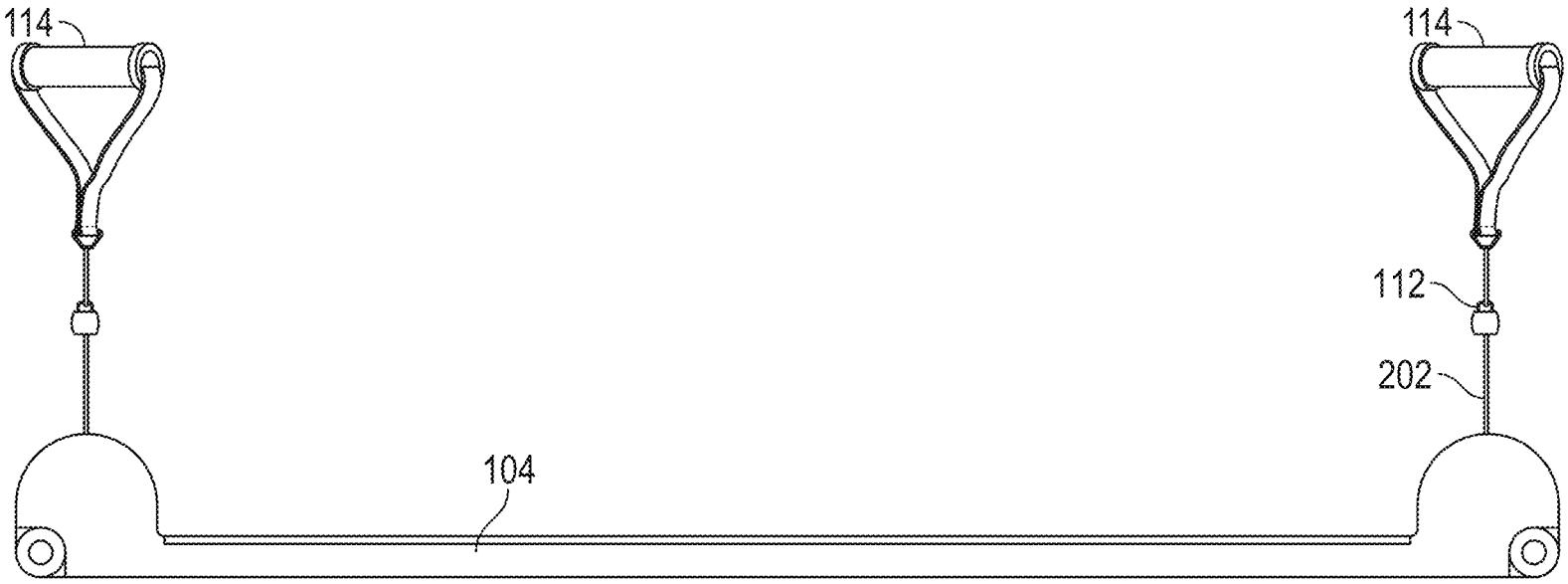

FIG. 2A and FIG. 2B show two configurations of the exercise device 102 in use, according to some examples. As shown in FIG. 2A and FIG. 2B, by attaching the bar 116 or the handles 114 to the attachment points 112, the cables 202 can be pulled up vertically or at a certain angle from vertical, under tension that is provided by two motors, one in each side pod 108. The tension in in each cable 202 provides the resistance for the training. The exercise device 102 is designed to mimic free weights like barbells, dumbbells, and so forth.

As shown in FIG. 2A, when the bar 116 is attached to the cables 202, a user can train as if the bar 116 is a barbell. Or, as shown in FIG. 2B, when the two handles 114 are attached to the attachment points 112, they can act independently to be used to train like two dumbbells. Other attachments may also be provided, like a short bar with one attachment point in the middle, a waist belt with two attachments on each side, an ankle/wrist strap with one attachment point, and so forth, can also be used to connect to one or both of the attachment points 112 to provide a variety of different workouts.

Hundreds of different exercises can be done to create a full-body workout using a barbell and two dumbbells. Accordingly, the exercise device 102 can be used to do many different exercise for full body resistance training. Since the two cables 202 can operate independently and with different tension forces, which can also vary dynamically, a user can do many different balance and stabilization resistance exercises with the exercise device 102 as well.

FIG. 3A (bicep curls), FIG. 3B (deadlift) and FIG. 3C (overhead press) illustrate three different strength exercises that can be performed by a user 302, using the exercise device 102 according to some examples.

Figure 4A:
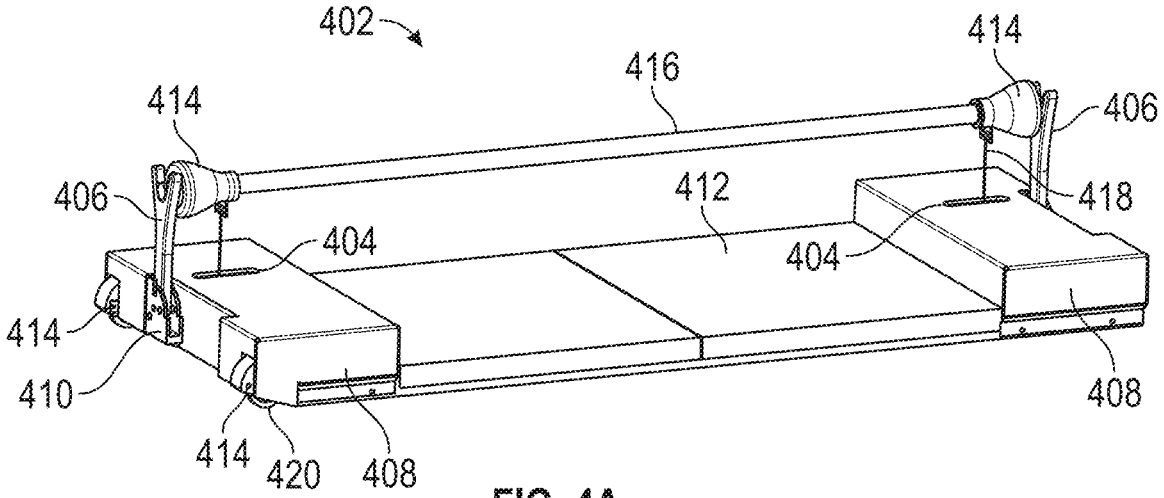
FIG. 4A and FIG. 4B show two configurations of a second version of the exercise device, according to some examples.
Figure 4B:
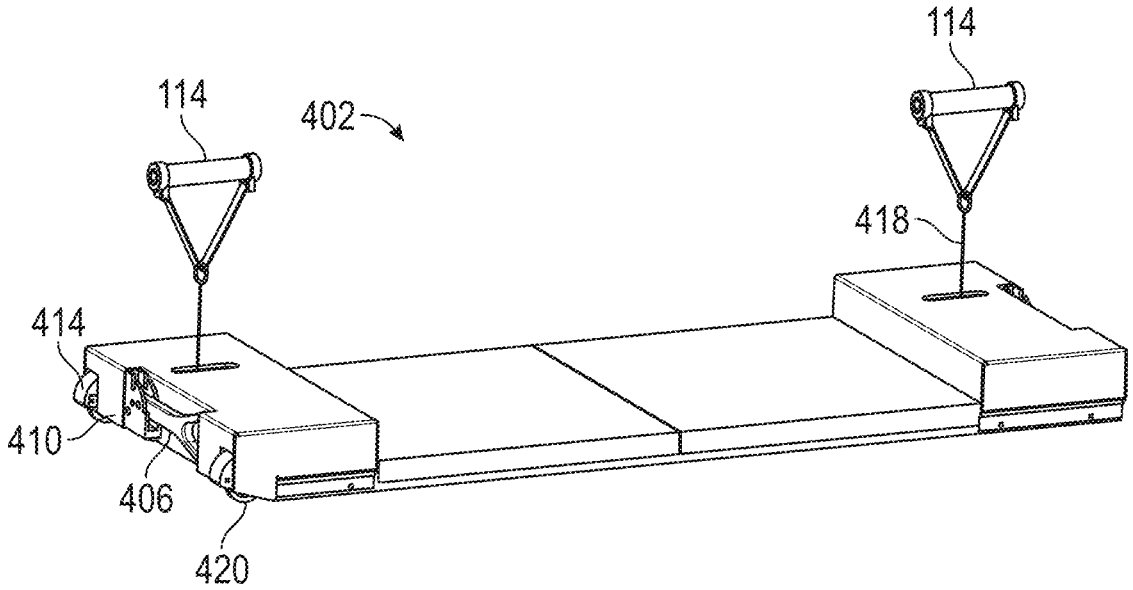

FIG. 4A and FIG. 4B show two configurations of a second version of the exercise device, according to some examples. The exercise device 402 in this case has rectangular side pods 408. Each side pod 408 has a slot 404 defined therein that permits side-to-side movement of each cable 418 in use. A Y-shaped bar holder 406 is rotatably coupled to each side pod 408 by means of a bracket 410. The bar holders 406, when in the vertical position shown in FIG. 4A, hold a bar 416 at a defined height above the platform 412, which makes it easier for the user to place their feet in alignment under the bar 416, as well as to permit more convenient grasping of the bar without having to lean all the way down to pick the bar off the platform or off the side pods 408. A user can break form if they need to lean all the way down to the pick the bar 416 up off the platform 412, which may lead to injury over a period of time.

Foot position relative to the points at which the cables 418 exit the side pods 408 is important for optimal form and to reduce the risk of injury. For example, if the bar 416 had to be picked from the platform 412, a user would not have room to locate their foot right under the bar 416 initially, which would make them stand further backwards on the platform next to the bar 116. This would either require the user to move forward after the bar 416 had been raised, or do the exercise with feet not in an optimal position, which will in turn cause the user to do the exercise in a nonoptimal form.

As shown in FIG. 4B, the bar holders 406 can be rotated out of the way to a horizontal position adjacent to the side pods 408 to facilitate unobstructed use of the handles 114 with the exercise devices 402.

Also shown in FIG. 4A and FIG. 4B are stops 414 above the wheels 420 on the side pod 408 on the left side, to assist with moving and storage of the exercise device 402.

Figure 5A:
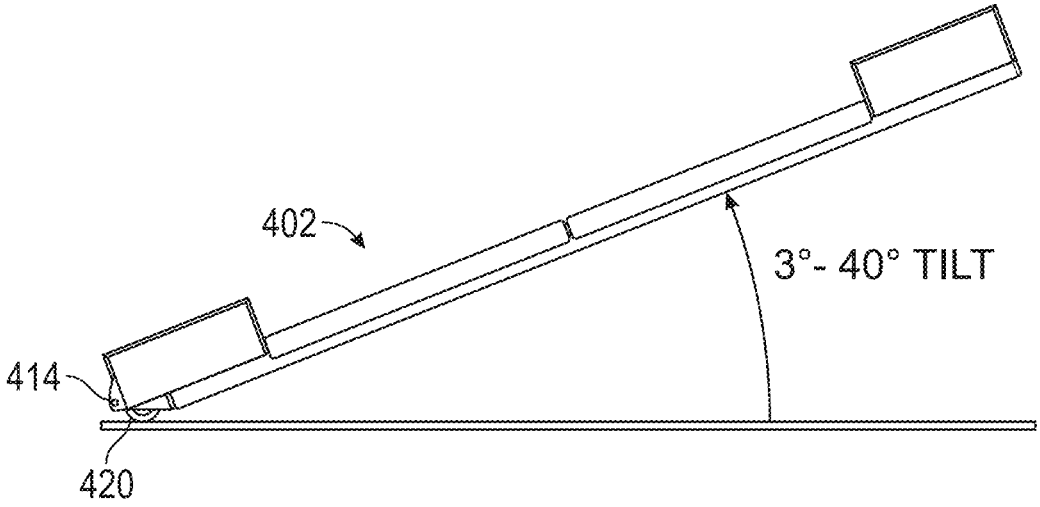
FIG. 5A and FIG. 5B illustrate moving and storing of the exercise device of FIG. 4A according to some examples
Figure 5B:
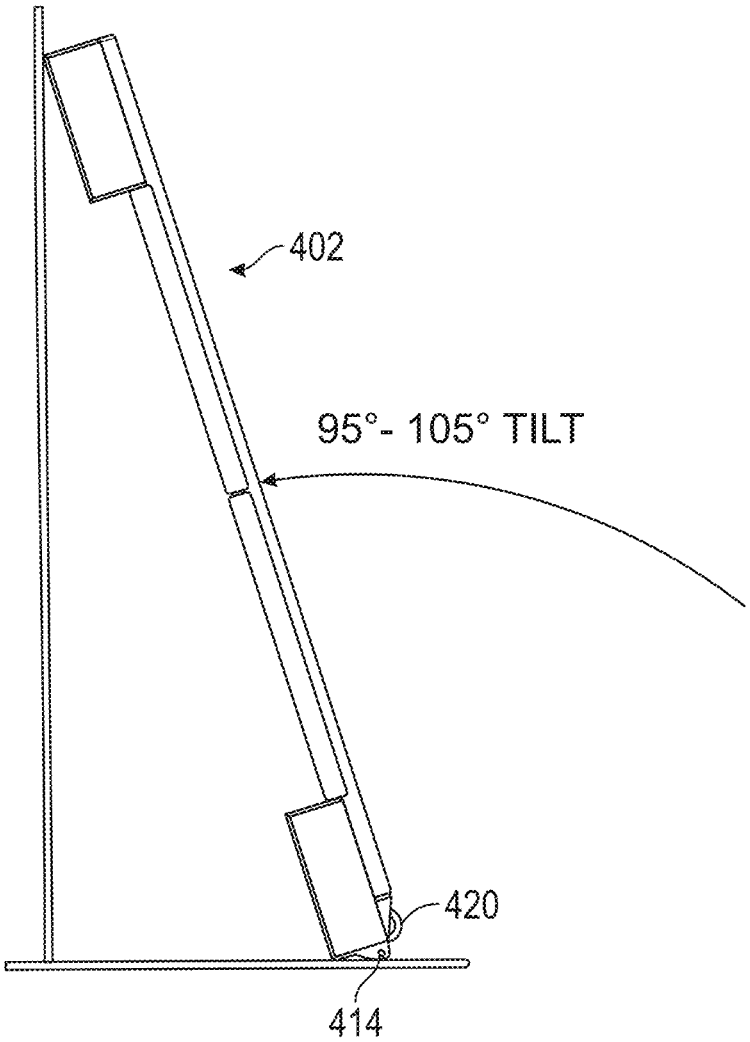

FIG. 5A and FIG. 5B illustrate moving and storing of the exercise device 402 of FIG. 4A according to some examples. As shown in FIG. 5A, the position of the wheels 420 and the stops 414 permit the exercise device 402 to be rolled along the ground when lifted to an angle of approximately 3 to 5 degrees and up to a maximum of approximately 40 degrees in some examples. Once a certain angle (40 degrees in the example) has been exceeded, the stops 414 engage the ground and the exercise device 402 can be tilted up to an approximately vertical position, where it can be leaned against a wall or other surface for convenient storage as shown in FIG. 5B. In this position the stops 414 engage the ground instead of the wheels, preventing the exercise device 402 from rolling away from the wall. Additional accessories or features may be provided to secure the device while being stored relatively upright or leaning against a wall.

Figure 6:
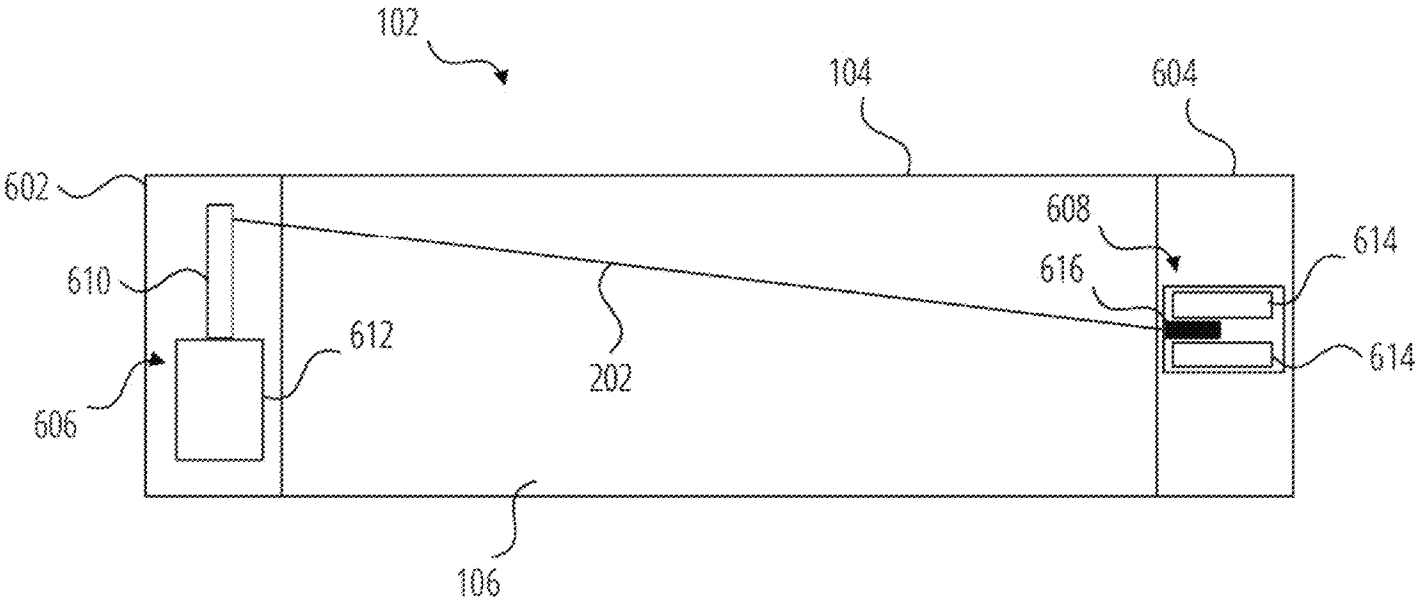
FIG. 6 illustrates the arrangement of components inside the exercise device to provide cable tension and management according to some examples.

FIG. 6 illustrates the arrangement of components inside the exercise device 102 to provide cable tension and management according to some examples. FIG. 6. is a schematic top view of the exercise device 102 showing the position of a retraction mechanism 606 in a left side pod 602 and a cable guide 608 in the right side pod 604. For purposes of clarity, the components are only described with reference to the cable 202 that exits the right side pod 604. It will be appreciated that the arrangement of the illustrated components is mirrored for the cable that exits the left side pod 602, but with the retraction mechanism in the right side pod 604 facing in the opposite direction so that the cables crisscross underneath the platform with a small clearance between the cables and an underside of the platform. This configuration of retraction mechanisms 606 and cable guides in opposite side pods with the cables passing in opposite directions allows a low platform height, which just needs to be sufficiently high to allow adequate cable clearance.

An example of the cable guide 608 is described in more detail below with reference to FIG. 7, FIG. 8, and FIG. 9, while an example of the retraction mechanisms 606 is described in more detail below with reference to FIG. 10 and FIG. 11.

The retraction mechanism 606 includes an electric motor 612 and a directly coupled long tubular threaded spool 610 onto which the cable 202 winds and unwinds in use of the exercise device 102, under torque that is applied to the threaded spool 610 by the motor 612. The cable 202 passes through the chassis 104 under the platform 106 from the threaded spool 610 to the cable guide 608. The spool is a zero-backlash mechanism to convert torque to tension, which may sometimes be powered manually or by an electric motor. An electric motor can also be called an electro-magnetic mechanism that uses electricity and magnetism to create torque.

The cable guide 608 in turn comprises a pulley 616 that receives the cable 202 from the retraction mechanism 606 and guides it upwards so that it is oriented generally vertically and can be attached via its attachment point 112 (not shown) to a handle 114 or the bar 116. Also provided are two rollers 614 that permit movement of the cable in a forward or backward direction (up or down in FIG. 6) relative to the platform 106.

Figure 7:
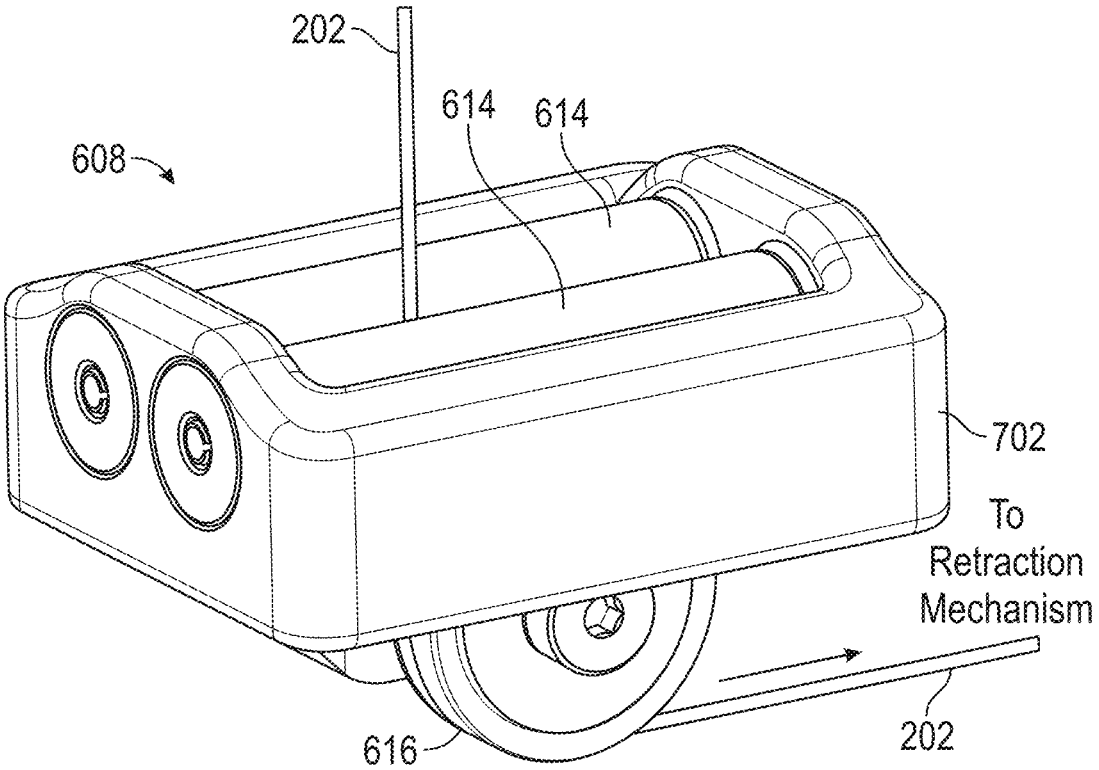
FIG. 7 is a perspective view of the cable guide of FIG. 6 according to some examples.

FIG. 7 is a perspective view of the cable guide 608 of FIG. 6 according to some examples. The cable guide 608 includes a housing 702 within which the two rollers 614 are rotationally mounted with the cable 202 exiting the housing 702 between the rollers 614. Below the housing, the pulley 616 receives the cable from the direction of the retraction mechanism 606 and turns it upward towards the attachment point 112 (not shown) where it can be attached to a bar 116 or a handle 114. The rollers 614 and the pulleys 616 are mounted to the housing using sealed ball bearings to provide quiet and low-friction movement of the cable 202. The elongated rollers 614 are parallel to each other and oriented in a direction across the exercise device 102 with a gap between them through which the cable passes. The pulley 616 is located underneath the gap between the rollers 614.

Figure 8:
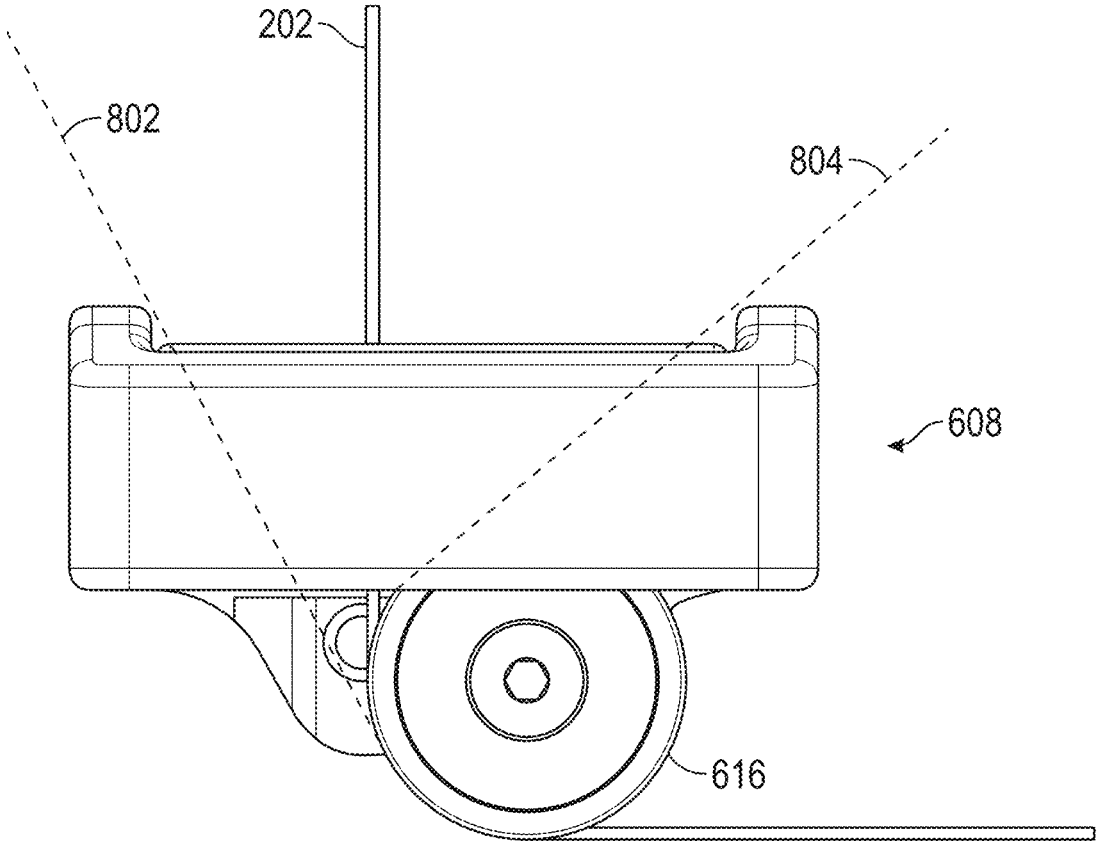
FIG. 8 is a front view of the cable guide of FIG. 6 according to some examples.

FIG. 8 is a front view of the cable guide 608 of FIG. 6 according to some examples. As can be seen, the arrangement of the rollers 614 and the pulley 616 permit functional side-to-side movement of the cable 202 between an outer limit 802 and an inner limit 804 within which the movement of the cable 202 does not interfere with the housing 702. The pulley 616 is positioned such that the vertical exit point of the cable 202 from the housing is offset to towards the outside of the exercise device 102 (away from the platform 106) so that the angle between vertical and the inner limit 804 is greater than the angle between vertical and the outer limit 802, since in use the handles 114 are likely to extend further over the platform 106 than away therefrom.

Figure 9:
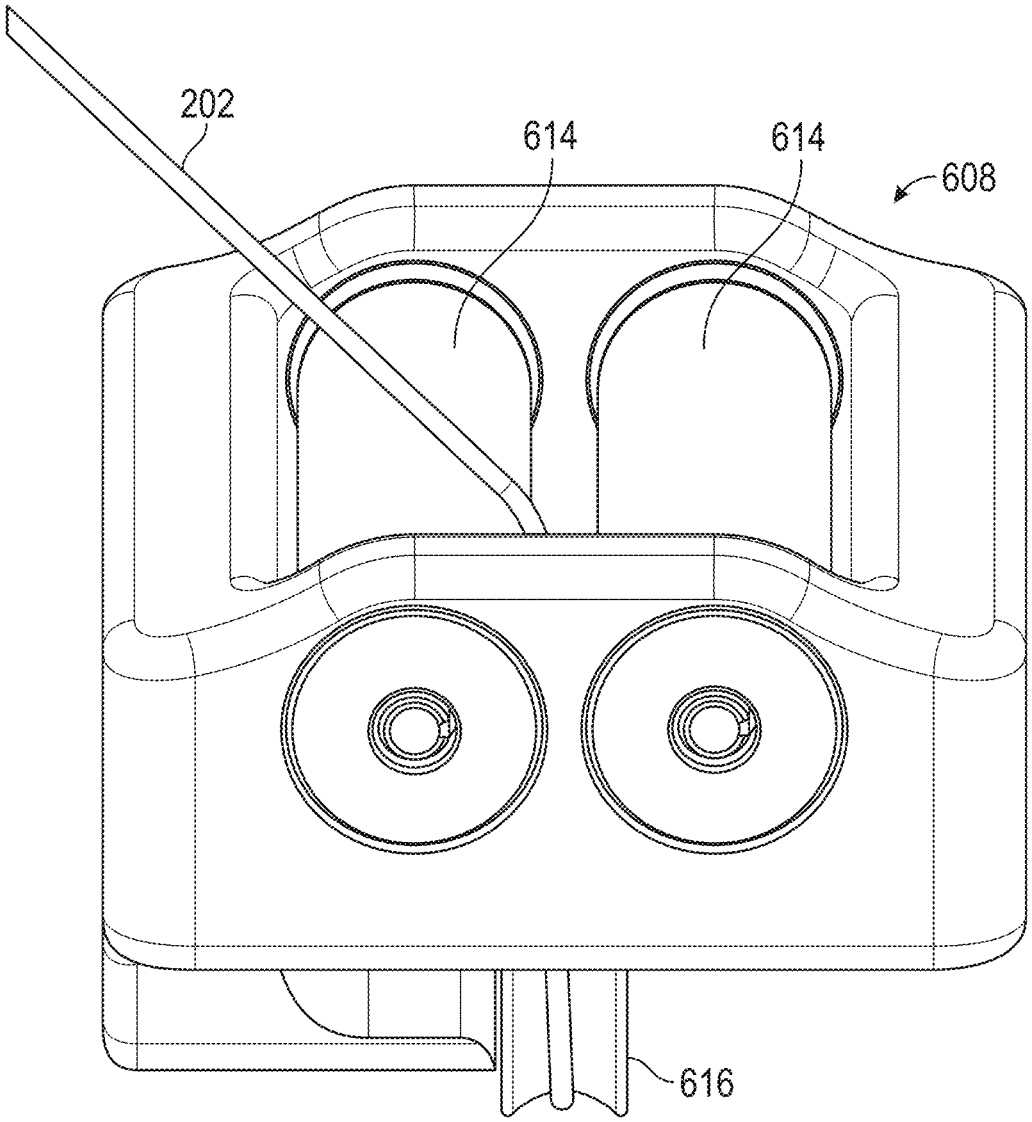
FIG. 9 is a side perspective view of the cable guide of FIG. 6 according to some examples.

FIG. 9 is a side perspective view of the cable guide 608 of FIG. 6 according to some examples. The arrangement of the pulley 616 below the gap between the roller 614 can clearly be seen in FIG. 9. Also, it can be seen that the rollers 614 permit the cable 202 to move functionally forward and backward over the exercise device 102 without it interfering with the housing. The arrangement of the rollers 614 and the pulley 616 ensure that the cable 202 can be moved not only in a vertical direction but also within a certain range of angles from the vertical in all four directions (left, right, forward, and backward).

Figure 10:
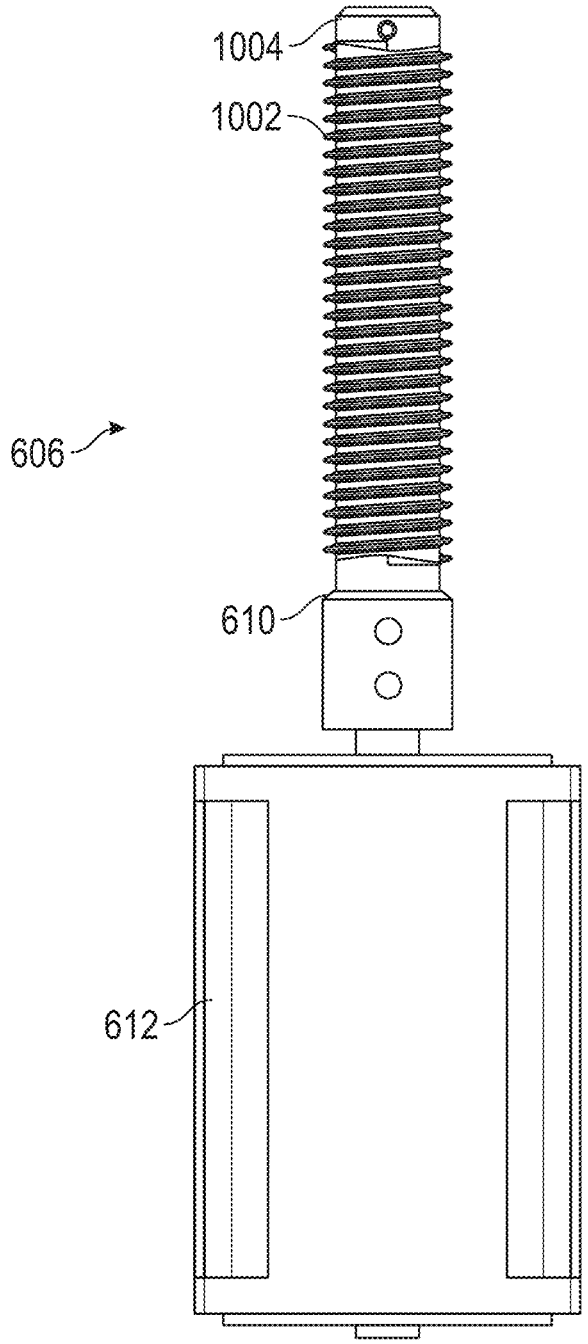
FIG. 10 is a top view of the retraction mechanism of FIG. 6 according to some examples.

FIG. 10 is a top view of the retraction mechanism 606 of FIG. 6 according to some examples. In use, the retractable cables wind and unwind on a long tubular threaded spool 610, which is coupled directly to the shaft of the motor 612, which is a brushless AC electric motor in some examples. The threaded spool 610 converts the torque and rotation of the motor 612 into tension and linear movement of the cable 202 in use.

A helical groove 1002 on the threaded spool 610 is sized to receive the cable 202 and ensures that the cable 202 winds smoothly onto and off the threaded spool 610 without overlap. The cable 202 is secured at the far end 1004 of the threaded spool 610 in some examples. The width of the groove 1002 matches the nominal thickness of the cable 202. The helical groove in the spool can be clockwise or anti-clockwise along the length looking from the direction of the motor, depending on the desired direction of rotation of the spool 610. When fully retracted, approximately 9 feet of cable 202 is wound on the threaded spool 610 to provide enough cable length for a user with a height of 6 feet 6 inches and proportionally long arms to hold a bar 116 fully extended vertically above their head as shown in FIG. 3C.

To provide rapid responsiveness and natural feel under cable acceleration (for example when initiating a movement or during a directional change during a movement, it is desirable that the motor and the threaded spool 610 have relatively low rotational inertia. Furthermore, additional rotating components such as gears or pulleys or belts or chains, especially with substantial mass and a large outer diameter, will add to the net rotational inertia of a rotating mechanism. Gearboxes additionally have backlash (also known as play or slop), which refers to the angle that the output shaft of a gearhead can rotate without the input shaft moving. Backlash can create noise and reduce responsiveness. The use of a direct drive motor without any gears, pulleys or sprockets or belts or chains between the motor 612 and the threaded spool 610 provides a low moment of inertia without backlash between the motor 612 and the threaded spool 610. In some examples, the groove 1002 may be fabricated directly into an extended shaft that protrudes from the motor 612.

The retraction mechanism 606 needs to create a relatively high force, for example up to 150 lbs on each cable 202, for a total maximum force of 300 lbs on the bar 116 in barbell mode. The maximum torque required can be determined by multiplying the required force by the radial distance from the center axis of the threaded spool 610 to the center of the cable 202 on the threaded spool 610. To create the required relatively high force, either the peak torque capacity of the motor 612 needs to be relatively high or the radius of spool needs to be relatively low. As the torque increases, motors become bigger, heavier and more expensive. To keep the cost and the weight of the exercise device 102 down, a light weight and low-torque motor is desirable, which requires that the radius of the threaded spool 610 be kept quite small, allowing relatively high force generation using a relatively small and low-torque motor.

As the radius of a conventional spool becomes smaller, problems can arise with the number of turns required to accommodate a long cable. This can result in the cable overlapping itself or require the provision of special winding mechanisms. To resolve these challenges, the threaded spool 610 is designed to an elongated rod or tube, with the length of the threaded spool 610 being defined by the length of cable wrapped in the helical groove of the spool. In some examples the length of the groove is a multiple (integer or non-integer) of at least twice its diameter.

With a spool having a thread to accommodate the cable, such as the threaded spool 610, the spool can become quite long to accommodate the approximately 9 feet of cable. A long spool can cause problems as the span between the cable being fully wound and fully unwound on the spool can become significant. There is also a certain limit to how wide (front to back) the exercise device 102 can be while still retaining a desirable form factor. Additionally, the platform 106 is quite low for user convenience, and does not itself provide sufficient room for a retractor mechanism. The dimensions of the threaded spool 610 will thus depend on a number of factors, including the width (front to back) of the exercise device 102, the desired size of the side pods 108, the bending forces that the threaded spool 610 will need to endure when the cable is under maximum design load at the far end 1004 of the threaded spool 610, motor size, torque and speed requirements, and so forth.

In one example, with a maximum motor torque of 7 Nm, a cable length to unspool of 9 feet and a spool pitch of 4 mm, the required 150 lb. force can be generated with a spool having a diameter of 21 mm, with a helix length of 167 mm and an overall spool length of 219 mm to accommodate the cable length. In this case the spool length is thus approximately ten times the spool diameter, although it will be appreciated that other integer or non-integer multiples are possible. Preferably the spool length is at least five times the spool diameter, but no less than twice the spool diameter.

Figure 11:
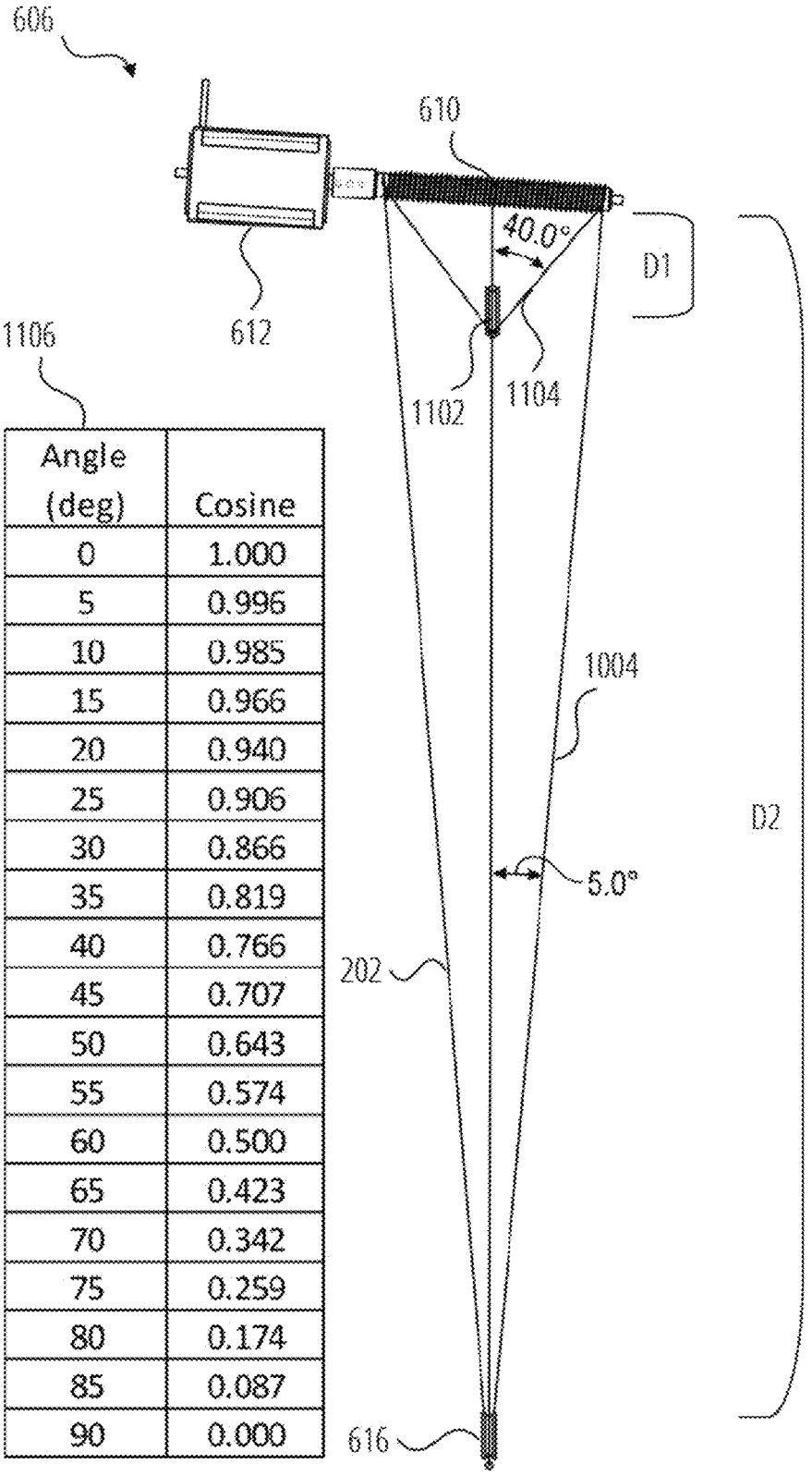
FIG. 11 is a top view of two potential locations of the cable guide relative to the retraction mechanism according to some examples.

FIG. 11 is a top view of two potential locations of the cable guide 608 relative to the retraction mechanism 606 according to some examples. FIG. 11 illustrates the effect of the distance between the retraction mechanism 606 and a pulley, which is part of the cable guide 608. As mentioned above, one of the challenges associated with a long spool is that the point at which the cable exits the spool can vary significantly as the cable winds and unwinds over the full length of the cable A moving exit point for a cable 202 from a side pod 108 end is undesirable, since this will either vary the direction of the force experienced by the user, or the user would have to walk back and forth on the platform 106 to maintain a constant relationship between their feet and the cable exit point.

When the exit point of the cable is generally fixed (within the variability provided by the cable guide 608 as described above), the angle at which the cable leaves the pulley towards the retraction mechanism 606 relative to the center of the spool 610, and the angle relative to the radial direction of the spool 610 at which the cable arrives at the threaded spool 610 need to be small to ensure that the force generated by the threaded spool 610 is transferred consistently to the cable 202. FIG. 11 shows two different situations with relatively close and further apart locations of the threaded spool 610 with respect to a pulley 1102 and a pulley 616. As can be seen for the closer pulley 1102, when the cable 1104 leaves the threaded spool 610 close to the end 1004 thereof, the angle between the cable 1104 and radial direction of the threaded spool 610 becomes large due to the short distance D1. However, in the case of pulley 616, located in the opposite side pod 108, the distance D2 between the pulley 616 and the threaded spool 610 results in a much smaller included angle between the cable 1104 and the radial direction of the threaded spool 610 as shown A large included angle, such as for pulley 1102, can have a number of undesirable consequences. The lateral reaction forces in the threaded spool 610 and the pulley 1102 created by the angle of the cable 1104 can increase friction and noise, the cable tends to grind on the edges of the grooves in the threaded spool 610 and the pulley 1102, and the tension in the cable 202 can vary quite a lot as it sweeps across the threaded spool 610. Also, the cable 1104 may pull out of the grooves in the threaded spool 610 or the pulley 1102 at large angles under high load. These disadvantages are avoided by crisscrossing the cables 202 under the platform 106 between the side pods 108. The platform 106 is low in height, but still has sufficient space for the cables 202 to crisscross under the top of the platform 106.

With a small included angle, all these issues are mitigated and the tension in the cable barely varies. The variation of the tension in the cable is a function of the cosine of the included angle, given by $F=T/(r \cos(\text{angle}))$, where T is the peak torque provided by the electric motor and r is the radius of the spool helix. For fixed T and r, F varies with variation in cos (angle). Cosine (angle) varies non-linearly with angle.

The cosine of an angle barely drops from the value 1 as the angle rises from 0 to 10 degrees, but after 30 degrees, the cosine of the angle drops rapidly as the angle rises above 30 degrees, as can be seen from the cosine table 1106. Hence, to avoid the above issues, the included angle should be kept under 15 degrees and more preferably under 10 degrees, but it doesn't have to be kept at zero, which allows the feasibility of such a cable management mechanism.

Figure 12B:
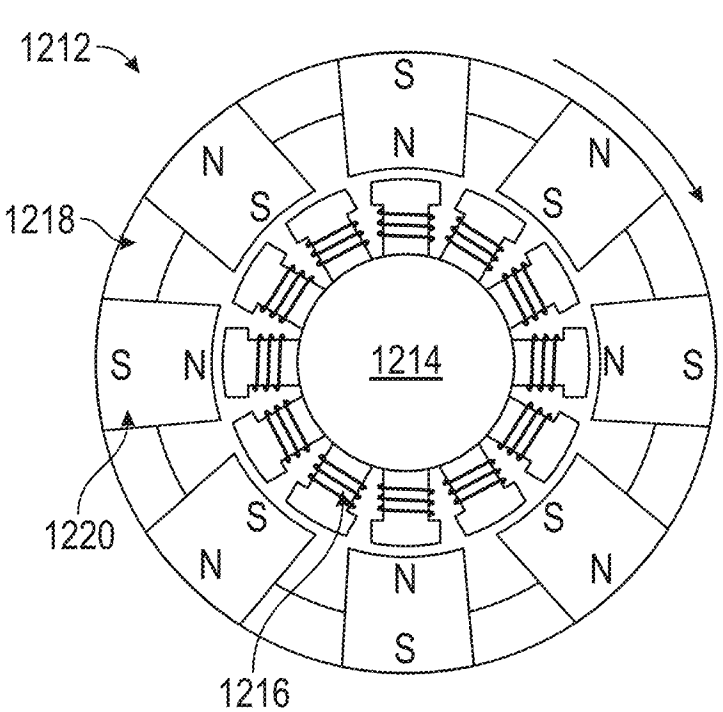
FIG. 12A and FIG. 12B illustrate two radial flux electric motor configurations according to some examples.
Figure 12A:
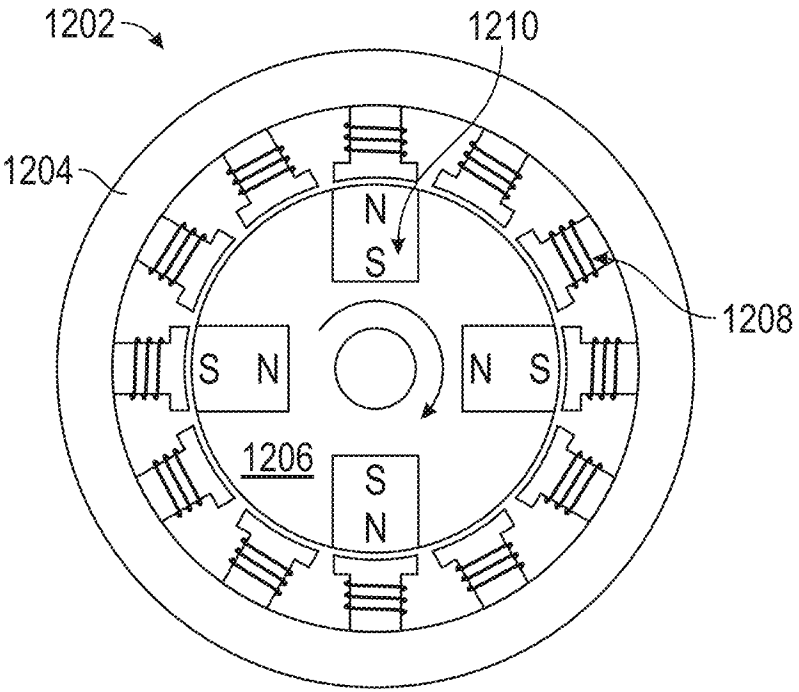

FIG. 12A and FIG. 12B illustrate two radial flux electric motor configurations according to some examples. FIG. 12A illustrates a first configuration of a radial flux motor 1202. The motor 1202 shown in FIG. 12A includes a stator 1204 including a number of coils 1208 each wound on a lamination stack, as well as a rotor 1206 including a number of permanent magnets 1210. The motor 1202 can be referred to as an inrunner motor because the rotor 1206 is located coaxially inside the stator 1204.

FIG. 12B illustrates a second configuration of a radial flux motor 1212. The motor 1212 includes a stator 1214 including a number of coils 1216 each wound on a lamination stack, as well as a rotor 1218 including a number of permanent magnets 1220. The motor 1212 can be referred to as an outrunner motor because the rotor 1218 is located coaxially outside the stator 1214.

The stator 1204 of an inrunner motor 1202 can be easily attached to the chassis or other structure of the motor 1202 chassis for better heat dissipation. Heat dissipation in an outrunner motor 1212 is complicated by the fact that the stator 1214 is located within the rotor 1218.

The thickness of the laminated stack along the axis of rotation is referred to as the stack length, and both motor 1202 and motor 1212 may have different stack lengths along the axis of rotation of the motor. Electric motors are usually cylindrical in shape, though their proportions vary based on the relationship between the outer diameter of the motor and the total stack length. If the total stack length of a radial flux motor is significantly greater than the outer diameter, the motor can be referred to as a rod shaped or tubular or sausage motor. If the total stack length of a radial flux motor is significantly less than the outer diameter it can similarly be referred to as a disk-shaped or a pancake motor.

The rotational inertia of the rotor of an electric motor can improve or exacerbate its controllability. Electric motors can be controlled for torque, speed or position. In the examples described herein, the motor 612 is controlled for desired torque while a handle 114 or bar 116 is moving at a variety of speeds and positions in both inward and outward directions. As described in more detail below with reference to FIG. 16 and FIG. 17, it is preferable to use a motor that has a lower rotational inertia, such as inrunner motor 1202, in which the material of the rotor 1206 is closer to its axis of rotation than the rotor 1218 of the outrunner motor 1212. Pancake motors in particular can have a very high and undesirable moment of inertia.

Figure 13A:
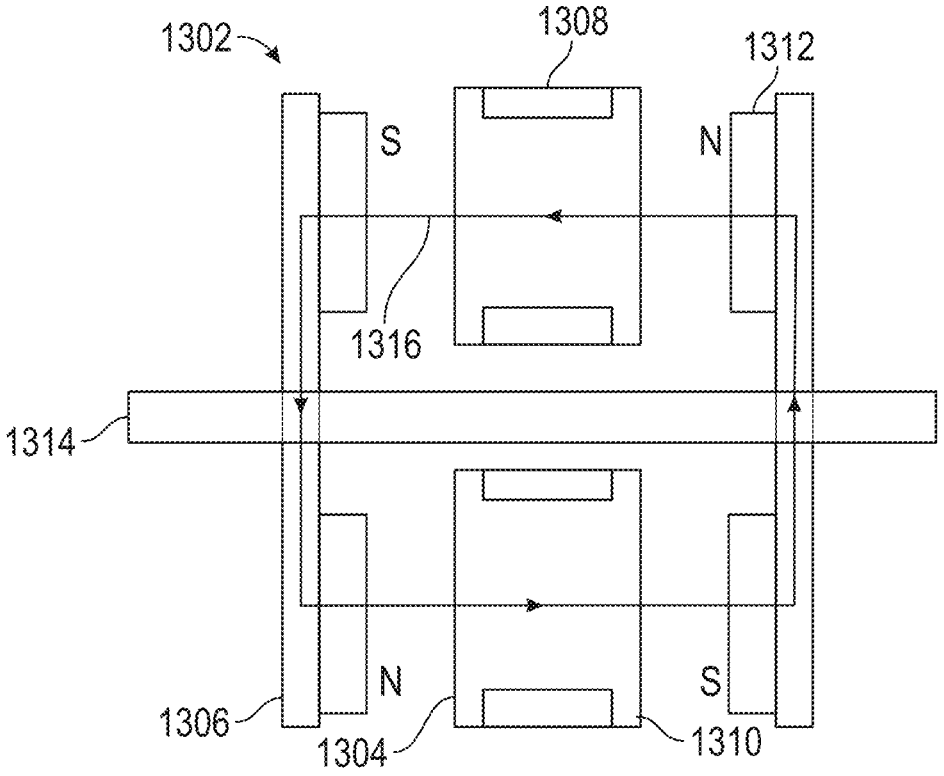
FIG. 13A and FIG. 13B are schematic side views of an axial flux motor and a radial flux motor according to some examples.
Figure 13B:
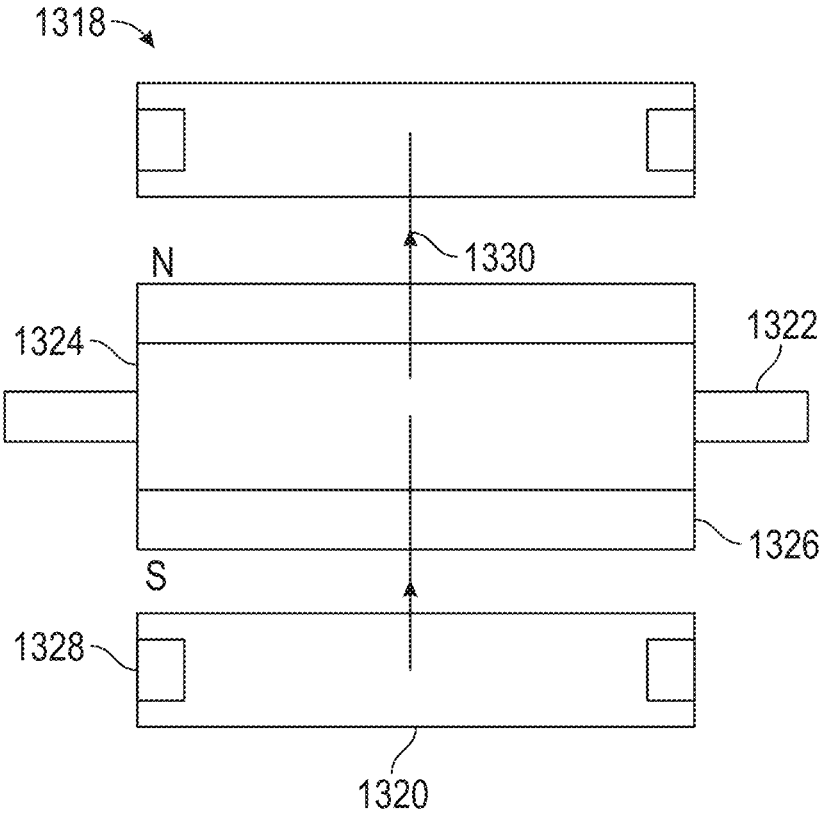

FIG. 13A and FIG. 13B are schematic side views of an axial flux motor 1302 and a radial flux motor 1318 according to some examples. The axial flux motor 1302 includes a shaft 1314 and a rotor 1306. The rotor 1306 is made of a back iron disk and has magnets 1312 on the inner face of the disk with their poles aligned along the axis of rotation of the shaft. The axial flux motor 1302 also includes a stator 1304 including coils 1308 wound on an iron core 1310. The space between the magnets and the stator is called an air gap. As can be seen from the figure, lines of flux 1316 are aligned along the axial direction of the motor in the air gap, hence the name.

The radial flux motor 1318 includes a includes a shaft 1322 and a rotor 1324. The rotor 1324 is made of a back iron cylinder and has magnets 1326 mounted on the periphery with their poles aligned across the axis of rotation of the shaft. The radial flux motor 1318 also includes a stator 1320 including coils 1328. As can be seen from the figure, lines of flux 1330 in the air gap are aligned along the radial direction of the motor, hence the name.

Figure 14:
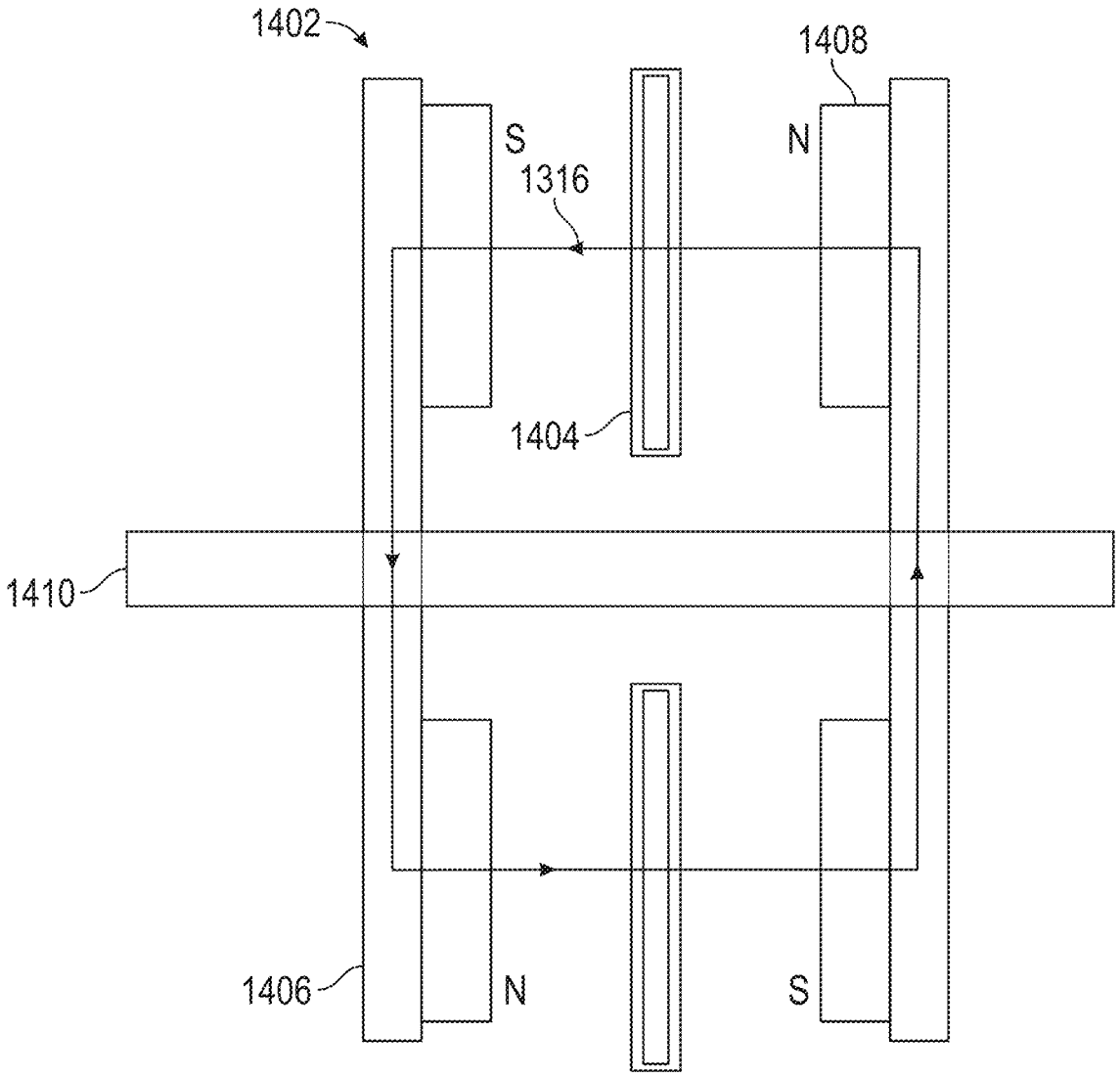
FIG. 14 is schematic side view of an axial flux motor with a PCB stator according to some examples.

FIG. 14 is a schematic side view of a specialized axial flux motor 1402 according to some examples. As before, the axial flux motor 1402 includes a shaft 1410 and a rotor 1406. The rotor 1406 is made of a back iron disk and has magnets 1408 mounted on the inner face with their poles aligned along the axis of rotation of the shaft. The axial flux motor 1402 also includes a stator 1404, which in this case comprises a printed circuit board (PCB) instead of the iron core 1310 of the axial flux motor 1302.

The copper traces on the PCB act as the winding and replace the winding 1308 of the axial flux motor 1302. Such a specialized axial flux motor 1402 is lighter, cheaper, easier to manufacture, has a low torque ripple and is smoother in operation with low audible noise compared to the axial flux motor 1302. Theoretically, a PCB stator motor can produce infinitely large amount of torque as the more and more current is passed through the stator winding, limited just by the thermal limits. An iron core stator motor is limited by the point at which the iron core magnetically saturates and won't produce any more torque as more and more current is passed through the stator winding.

Figure 15A:
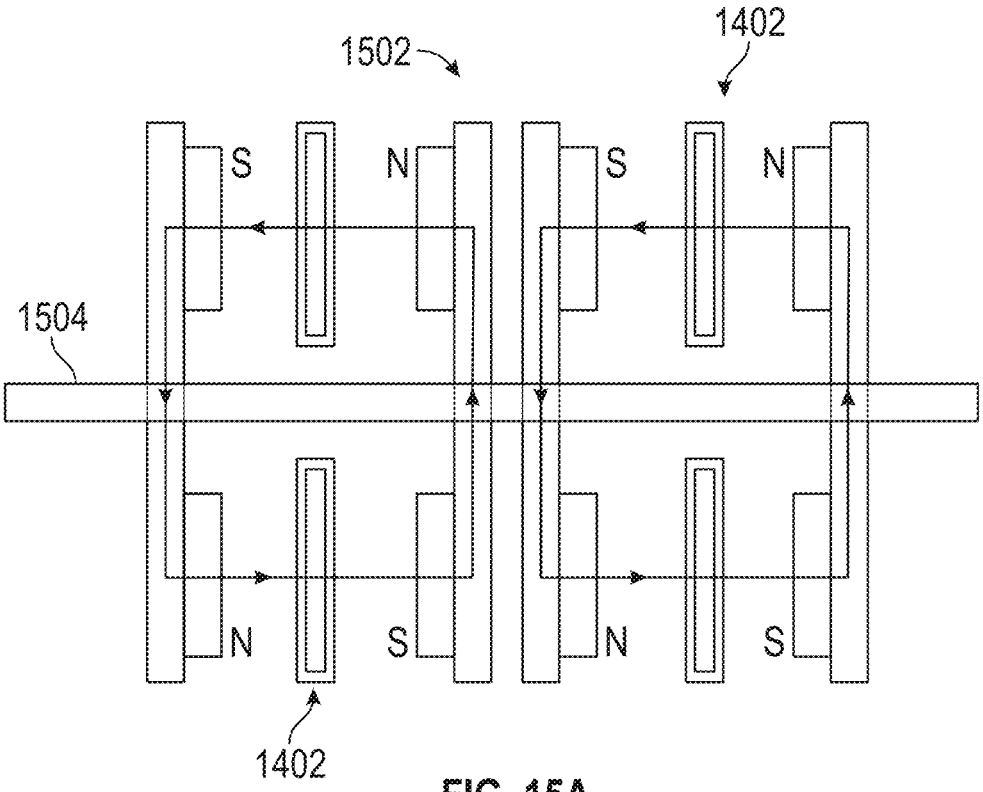
FIG. 15A and FIG. 15B are schematic side views of a stacked axial flux motor and a pseudo-stacked axial flux motor respectively, according to some examples.
Figure 15B:
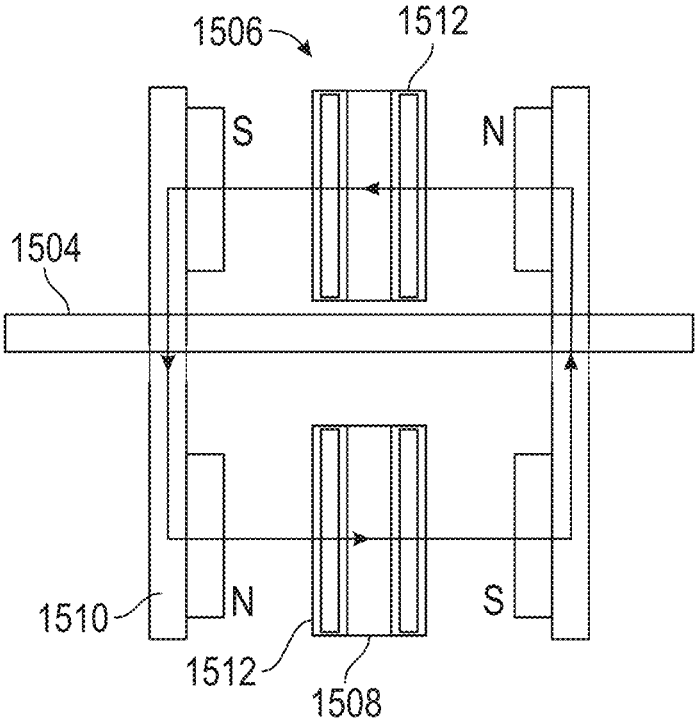

FIG. 15A and FIG. 15B are schematic side views of a stacked PCB stator axial flux motor 1502 and a pseudo-stacked PCB stator axial flux motor 1506 respectively, according to some examples. As can be seen, the axial flux motor 1502 in FIG. 15A comprises two axial flux motors 1402 mounted adjacent to each other on a shaft 1504 along the axis of the motor. This doubles the peak torque capacity of the motor, but this arrangement results in double the rotational inertia, which is not desirable for this application. Axial flux motors are usually shaped like a pancake because their outer diameter is much larger than their stack length, which is the total width of the motor along the axis of rotation. Stacking axial flux motors can make the resulting motor look more tubular than like a pancake.

The axial flux motor 1506 in FIG. 15B is a pseudo-stacked implementation of a PCB stator axial flux motor. In this case, PCBs 1512 are provided in a stacked configuration on either side of a single iron core stator 1508 between two rotors 1510. The iron core in the stator does a better job at concentrating the magnetic lines of flux, compared to just PCB stator. This reduces the needed volume of magnets on the rotor and the thickness of the back iron on the rotor. This also gets rid of the two inner disks of rotor as seen in FIG. 15A. Both these factors provide a much lower rotational inertia while providing same torque and power output comparable to the axial flux motor 1502 shown in FIG. 15A, so as to be better suited for use in the exercise device 102. Such a pseudo-stacking implementation also makes the motor look more tubular than pancake-shaped.

Figure 16:
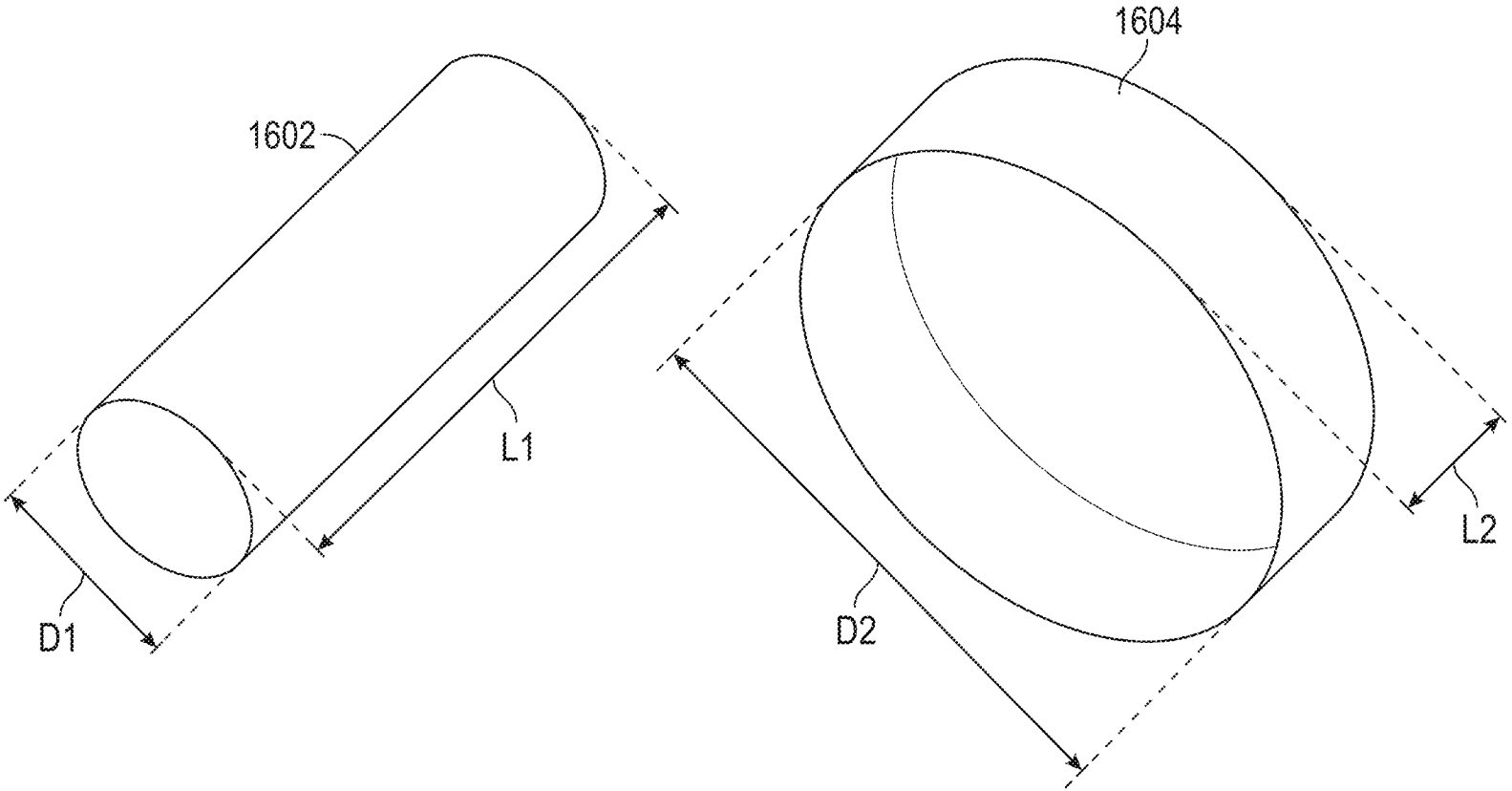
FIG. 16 illustrates the effect the shape of a solid cylinder has on its rotational inertia according to some examples.

FIG. 16 illustrates the effect the shape of a solid cylinder has on its rotational inertia. Shown in the figure are a solid, rod-shaped cylinder 1602 having a length L1 and a diameter D1, and a solid, disk or pancake-shaped cylinder 1604. The cylinder 1602 and the cylinder 1604 have an identical mass and density. The moment of inertia of a solid cylinder about its primary axis is determined by I=½MR^2. If L1 is ten times L2 with cylinder 1602 and cylinder 1604 having the same volume, then 10D1=D2 and the cylinder 1604 has 100 times the rotational inertia of 1602. Hence, a rod-shaped rotor in an inrunner radial flux motor 1202 will have significantly lesser rotational inertia compared to the pancake-shaped rotor of an outrunner radial 1212 flux motor, making the inrunner radial flux motor 1202 better suited for this application.

Figure 17:
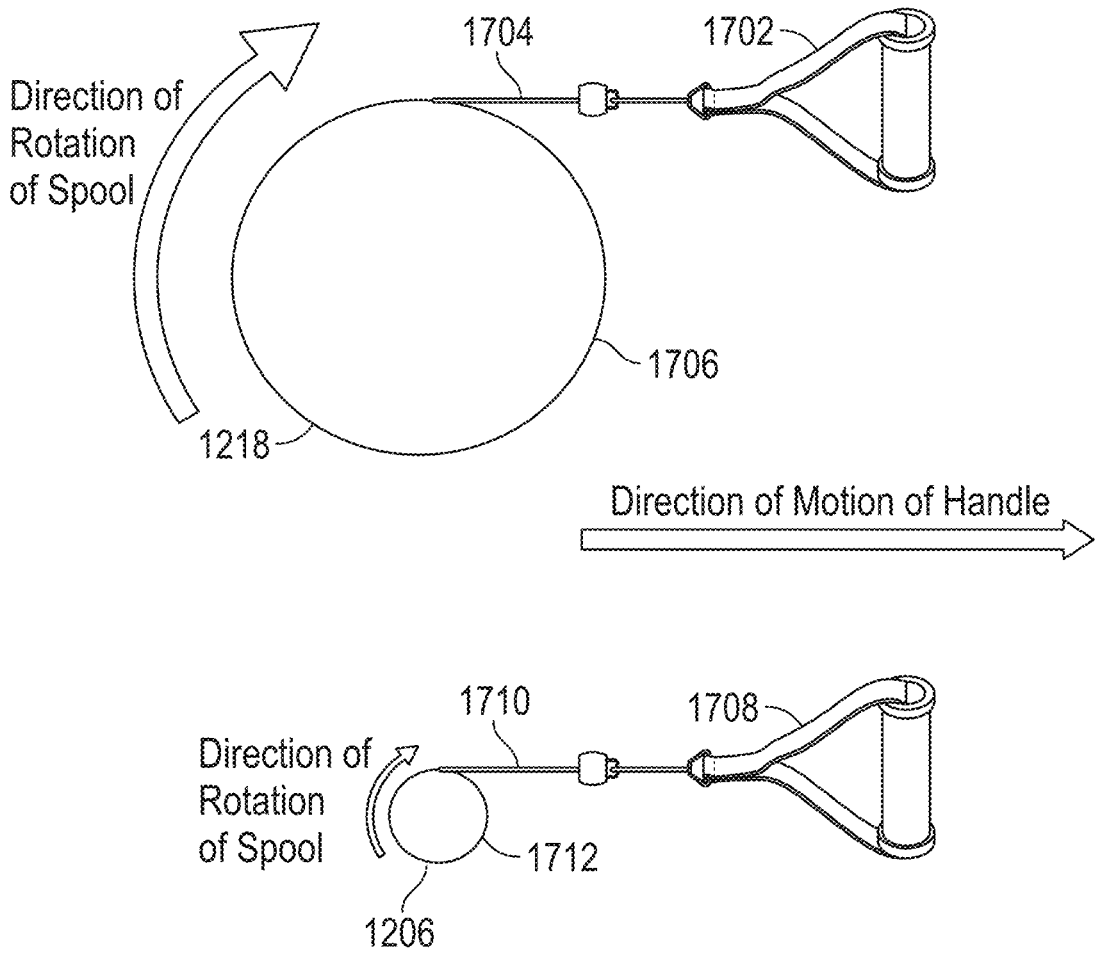
FIG. 17 illustrates the effect of rotational inertia in the exercise device according to some examples.

FIG. 17 illustrates the effect of rotational inertia in the exercise device 102 according to some examples. In the first example, a handle 1702 is used to pull a cable 1704 off a pancake shaped spool 1706 that is coupled to a rotor 1218 in an outrunner radial flux motor 1212, while in the second example a handle 1708 is used to pull a cable 1710 off a rod shaped tubular spool 1712 that is coupled to a rotor 1206 in an inrunner radial flux motor 1202. Assuming that the combination of rotor 1218 and spool 1706 and the combination of rotor 1206 and spool 1712 are of equal mass, the rotational inertia of the former will be significantly greater than the rotational inertia of the latter due to the mass of the rotor 1218 and spool 1706 being distributed further away from the axis of rotation of the motor 1212.

When handle 1702 in FIG. 17 is initially pulled away from the spool 1706, the unwinding of the cable 1704 is resisted both by the torque applied by the motor 1212 and the rotational inertia of the rotor 1218 and spool 1706, until the handle 1702 stops accelerating. This causes an undesired increase in tension in the cables 1704 above the nominal tension created by the torque of the motor 1212. Similarly, when the handle 1702 stops being pulled, the rotational inertia of the rotor 1218 and spool 1706 causes them to tend to keep rotating, which causes an undesired reduction in in the tension in the cable 1704 under the nominal tension created by the torque of the motor 1212 until the spool 1706 comes to a stop. In extreme cases, the cable 1704 can in fact go slack. The amount of time it takes for the combination of the spool 1706 and the rotor 1218 to reach top speed or come to a complete stop is also greater for a greater rotational inertia, affecting the responsiveness of the exercise device 102. While reversing direction of motion of the cable 1704, sometimes the tension in the cable can rise rapidly from slack, causing a sudden and undesirable tug on the handle 1702.

For an equivalent motion by the handle 1708, the reduced rotational inertia of the rotor 1206 of the inrunner motor 1202 and the spool 1712 will result in more consistent tension in the cable and better responsiveness of the exercise device 102. It is desirable for the tension in the cable 202 of the exercise device 102 to be as directly related to the torque generated by the motor 612 as far as possible, regardless of the speed or acceleration of a handle 114 or the bar 116 that may occur in use. A high moment of inertia can cause a decoupling of the torque generated by the motor 612 and the tension in the cable 202

Inertial effects such as these may be enough to create a perceptible drop in tension in the cable. This is undesirable and can make the feeling of exercising using cables very different when compared to exercising using free weights, unless movement takes place at relatively slow speeds. To operate at relatively high speeds and create a feeling as close as possible to that of free weights, the time and amount by which the tension in a cable differs from the desired value should be kept as small as reasonably possible. Keeping the rotational inertia of the rotating components as low as possible is preferred.

In the illustrated examples, the rotational inertia is reduced by using a tubular threaded spool 610 directly coupled to an inrunner motor 1202. Pancake motors typically have a higher rotational inertia, which make them less desirable for use in the exercise device 102.

In some examples, the motor 612 is a brushless AC electric motor with three sets of windings or coils, or a multiple of three sets of windings. Current passing through the coils generates varying magnetic fields that interact with the fixed magnetic fields created by the magnets on the rotor, thereby to create torque in the motor. An AC electric motor provides the ability to produce desired values of torque in a specified range of torques from a minimum value to maximum rated value, independent of the position or speed of the rotor. This provides the ability to vary the torque generated by the motor 612 in a controllable manner.

Figure 18A:
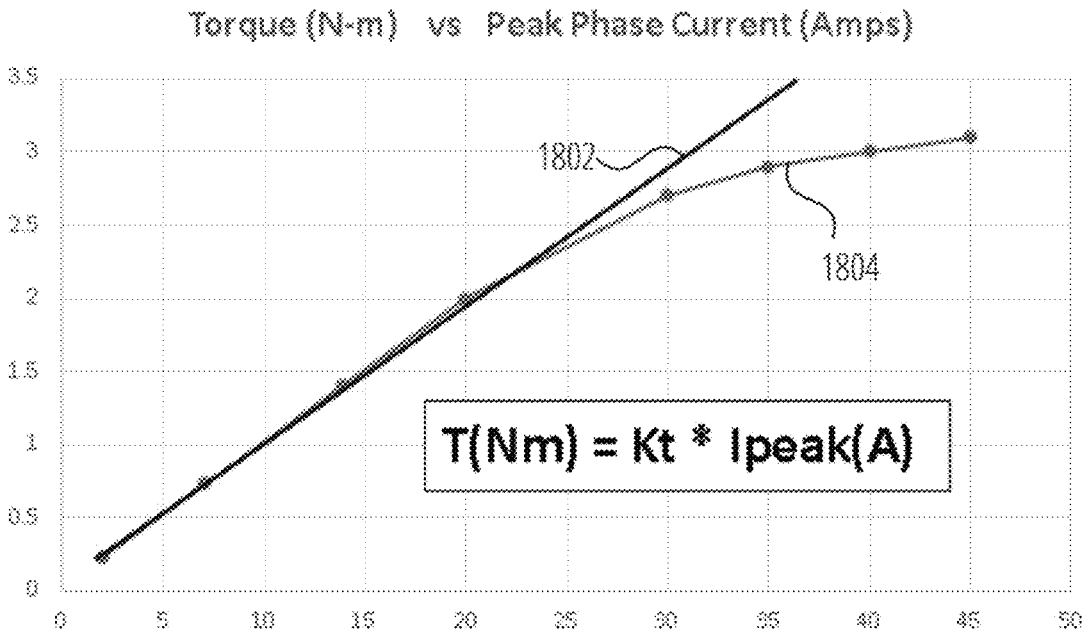
FIG. 18A and FIG. 18B are two charts illustrating electric motor characteristics according to some examples.
Figure 18B:
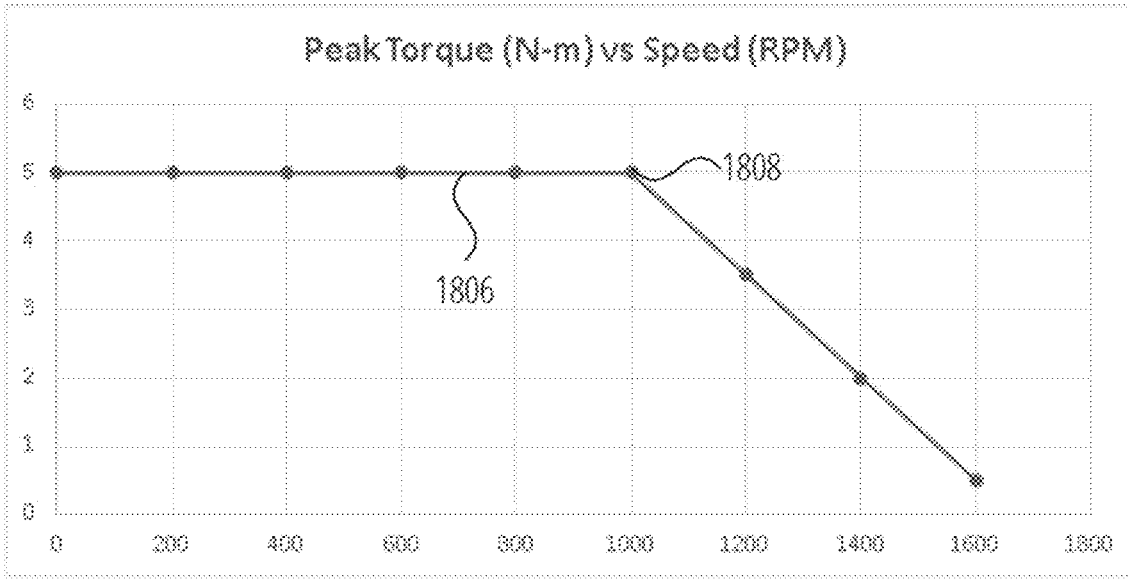

FIG. 18A and FIG. 18B are two charts illustrating electric motor characteristics according to some examples.

The relationship between the peak phase current applied to the coils and the torque generated by the motor 612 is given by a constant Kt, which is known as the torque constant. This linear relationship is shown in one example in FIG. 18A, which shows the theoretical line 1802 between torque and peak current as well as a curve 1804 of the actual performance of the motor. As can be seen, the curve 1804 matches the line 1802 well up to a certain point, but beyond a certain current value, called the saturation knee point, the relationship diverges and further increases in current don't create proportionally more torque. This happens because at certain point all the dipoles in a magnetic material (often the iron core) get fully aligned, known as magnetic saturation. For an air core or PCB stator motor in which the core is non-magnetic, Kt will be lower, but it almost never saturates and can theoretically keep rising to infinity. The value of Kt and the saturation knee point is a function of the type and configuration of the motor, the material used, and shape/size of the motor and stays relative constant for motors having the same characteristics. The Kt of a motor can be used to generate a sufficiently accurate torque value with just current sensors, without the need for a torque or force sensor.

To create a certain amount of tension in a cable, a certain amount of torque needs to be created by the motor. That is done by passing a certain amount of current (Io) through each of the coils in the set of coils. In a motor with three phases, the phases are 120 degrees apart, and the three different windings will need to have three different values of currents given by equation:

$$IA=I0*\sin(wt)$$

$$IB=I0*\sin(wt+120\text{ deg})$$

$$IC=I0*\mathrm{Sin}(wt-120\text{ deg})$$

where wt is the angle between the rotor and the stator.

To pass an exact current value through each winding, three different current controller blocks are provided, and a current sensor is provided on each phase or at least current sensors on two out of the three phases while the third phase current value can be estimated from the two measured current values. An encoder on the rotor is also used to measure the relative angle between the rotor and the stator, called an electrical angle. The encoder can also be used to measure the rotational speed of the rotor. The encoder needs to have sufficient resolution to create enough accuracy in the measured electrical angle between the rotor and the stator. Three hall sensors fixed on the stator can also be used to estimate electrical angle with a lower accuracy, if an encoder attached to the rotor is not available.

The maximum available torque as a function of motor speed is shown in FIG. 18B. As can be seen, a plot 1806 of the peak torque vs. motor speed is constant up to a certain speed 1808, at which point the peak torque begins to drop as the speed increases. As long as the required combination of the speed and torque of the motor is below the peak torque 1806 and the rated peak speed 1808, the exercise device 102 can function as designed and specified. Usually, the speed of an exercise is lower at high weights and higher at low weights, due to the inherent peak power constraints of muscles. If the bar 116 or a handle 114 is dropped at high force, the motor achieves high enough speed while the cable is being spooled in such that the available torque (and hence the available force) drops significantly, which makes the exercise device 102 inherently safer compared to dropping a heavy barbell. Additionally, a current shutoff can be set to trigger if the speed of the motor exceeds a certain limit, indicating that the bar 116 or a handle 114 has been dropped.

Figure 19:
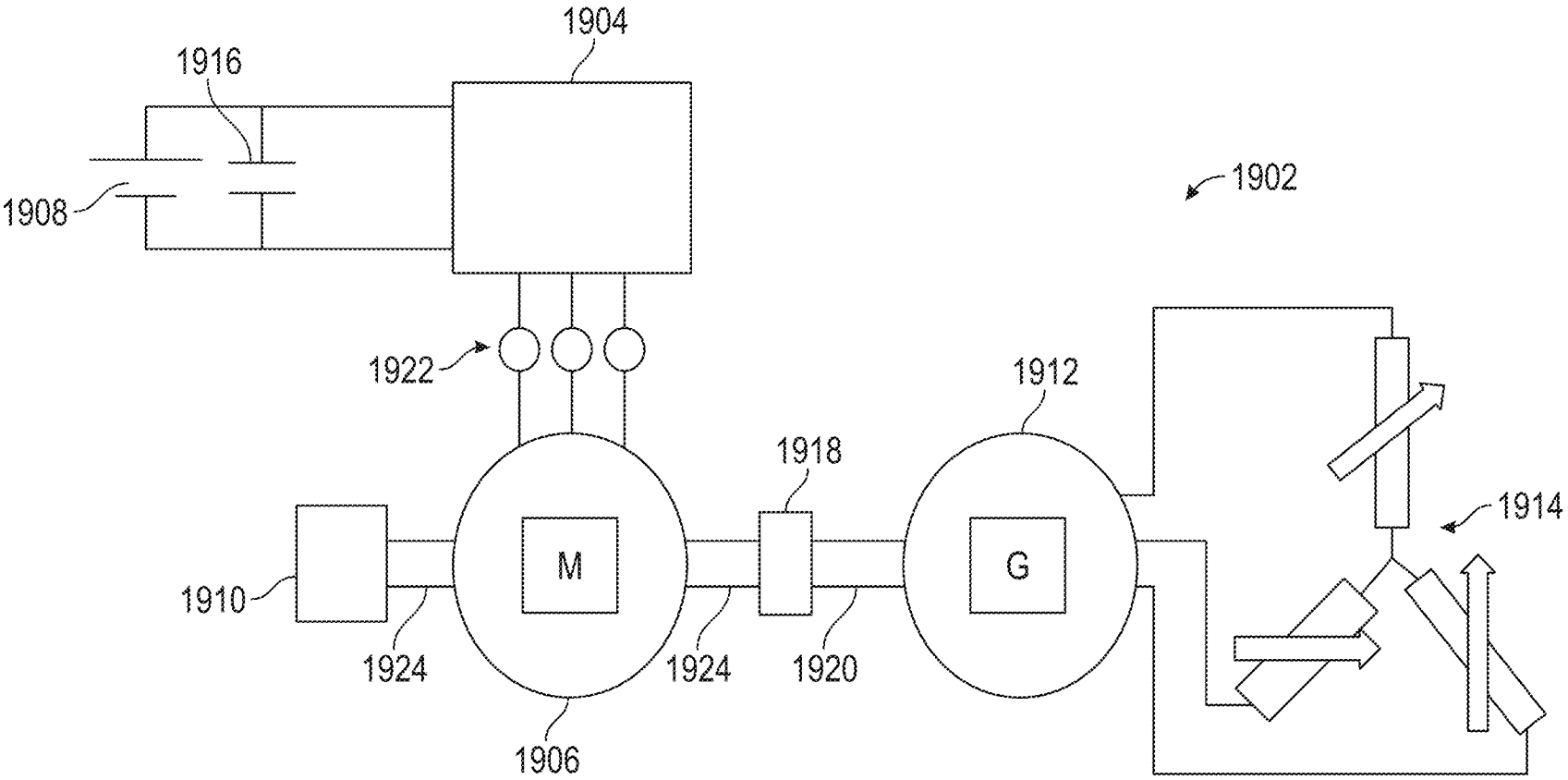
FIG. 19 illustrates a test setup to determine the torque constant of a motor according to some examples.

FIG. 19 illustrates a test setup 1902 to determine the torque constant of a motor 1906 according to some examples. The test setup 1902 includes the motor 1906, inverter 1904, DC link capacitor 1908 and a battery pack 1916. Three current sensors 1922 measure the amount of current provided to the motor 1906 from the inverter 1904 on each of the three phases of the motor 1906. Attached to one end of a motor shaft 1924 is a rotational encoder 1910 and attached to the other end of the motor shaft 1924 is a torque sensor 1918.

Also provided is a generator 1912 with a variable resistor load bank 1914. The generator 1912 has a generator shaft 1920 that is also attached to the torque sensor through a shaft coupler.

Using the variable resistor load bank 1914, the generator 1912 can provide a set torque (as measured by the torque sensor 1918) to resist turning of the shaft by the motor 1906. By running the motor at various speeds (as determined from output from the encoder 1910) and torque levels, the charts illustrated in FIG. 18A and FIG. 18B can be generated, and the torque constant Kt and related parameters for the motor 1906 can be determined.

Figure 20:
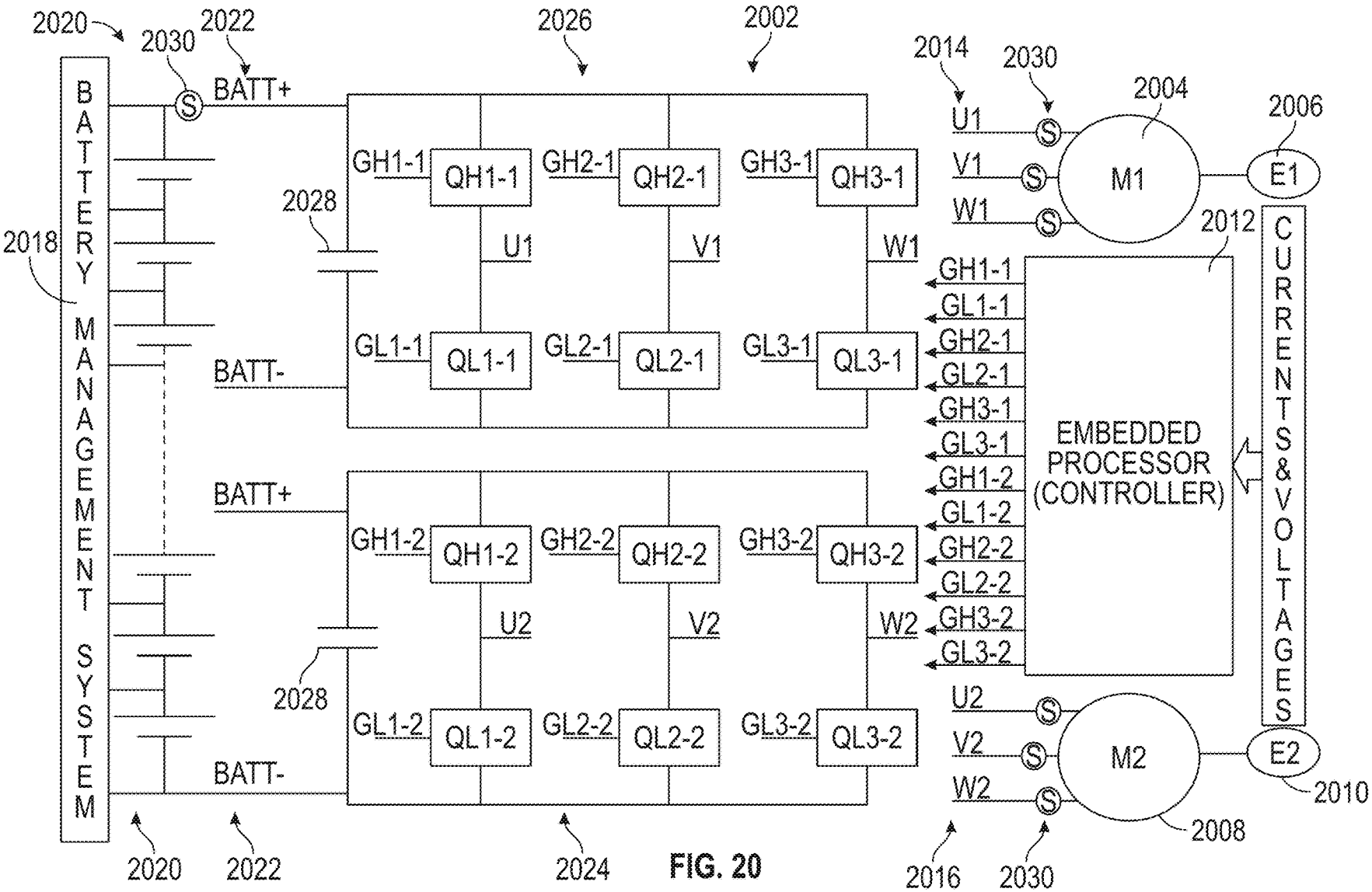
FIG. 20 illustrates an electrical control system and related components for the exercise device according to some examples.

FIG. 20 illustrates an electrical control system 2002 and related components for the exercise device 102 according to some examples. Illustrated in FIG. 20 are a left motor 2004 with a left encoder 2006 and left motor terminals 2014, a right motor 2008 with a right encoder 2010 and right motor terminals 2016, an embedded processor (microcontroller) 2012, a rechargeable battery pack 2020 with a battery management system 2018, and a left motor hex bridge inverter 2026 and a right motor hex bridge inverters 2024. The battery terminals 2022 are coupled to the hex bridge inverter 2024 and hex bridge inverter 2026, which are in turn coupled to the left motor terminals 2014 and right motor terminals 2016 respectively. The hex bridge inverter 2026 and hex bridge inverter 2024 are each independently controlled by the embedded processor 2012 to provide a current through each motor that will generate a required torque in the left motor 2004 and right motor 2008 respectively.

The control system 2002 for an AC motor is often called as an inverter as it takes DC voltage and coverts it into three phase AC voltage that then drives the AC motor. The control system 2002 comprises a dual inverter that can independently drive the left motor 2004 and right motor 2008. The embedded processor 2012 manages the exercise device 102 using seven sensors 2030 for current and voltage (one on each winding of each motor and one on the DC input bus current), a left encoder 2006 for the left motor 2004 and a right encoder 2010 for the right motor 2008. The embedded processor 2012 sends pulse-width modulation signal commands separately to the hex bridge inverter 2024 and hex bridge inverter 2026, each of which comprise 6 electronic MOSFET switches.

The DC inputs from the battery terminals 2022 to the hex bridge inverter 2026 and hex bridge inverter 2024 each include a DC link capacitor 2028 to reduce higher frequency voltage and current ripple. If the PWM frequency is less than 20 khz, audible motor noise may be created due to the creation of vibrations at frequencies that are audible to humans. Accordingly, the PWM frequency used by the embedded processor 2012 is greater than 20 kHz and can for example fall within a range of 30-60 khz. Higher PWM frequencies also create cleaner sinusoidal current waveforms with less torque ripple in low inductance motors, which can further reduce audible noise and improves motor efficiency. Motors that have quicker responses will often have very low inductance and are desirable in an application like this to provide quick responsiveness. The switching losses in the MOSFET switches increases with higher PWM frequencies, hence the gate drive circuit for each MOSFET is designed carefully in the PCB layout and configured to reduce gate ringing and switching losses in the MOSFETs To provide a DC input power source, a battery pack 2020 is used instead of a DC power supply. In use, the exercise device 102 may draw high power from the battery pack 2020 for short periods of time during movement of the bar 116 or handles 114 in one direction, with a quick return to low power or no power when moving in the other direction. The power draw is usually higher while the cable 202 is being retracted, compared to when the cable 202 is being withdrawn. Each motor may act as generator while the user is lifting the bar 116 or a handle 114, thus consuming low power or even negative power. Negative power draw means that current tends to flow back from the motor to the inverter and the DC power source.

Standard DC power supplies that run off the electrical grid are normally unable to receive current or power in such situations as they are usually unidirectional by design. Hence, the excess power is diverted to power resistors to dissipate as heat. If the excess power is not diverted, the DC bus voltage in the DC link capacitors 2028 can rise to dangerous levels leading to permanent damage to the capacitors and/or the MOSFETs and/or the power supply. Bidirectional power supplies exist that return power to the electrical grid, but they are heavy and expensive.

Using a battery pack 2020 as the power source permits power to be returned to the battery pack 2020, which avoids the need for power resistors, keeps the exercise device 102 cooler and also proves to be energy efficient. Additionally, battery packs 2020 are good at providing high current levels for short periods of time due to their lower internal resistance. The size and cost of the battery is thus not defined by the peak power requirement but instead by the total energy consumed. Hence, using a battery pack 2020 instead of a DC power supply can make the exercise device 102 cheaper and lighter. The size and cost of a DC power supply is defined by the peak power requirement, which makes them heavier and expensive Additionally, use of the exercise device 102 is made more convenient and flexible by providing a battery pack 2020 instead of a DC power supply, which needs a thick power cord connected to the power outlet, that brings high voltage AC down to the device and corresponding safety concerns especially the risk of an electric shock in case of a fault. A long power cord or extension cord can also act as a trip hazard. A small low voltage DC output trickle charger can be used that slowly charges the battery pack 2020 over a period of time when the device is not in use. The relatively higher voltage from the power outlet just goes to the trickle charger and not the exercise device 102. The charger module can be a wall outlet mount module that may have already been certified. The battery management system 2018 keeps track of the voltages in the cells of the battery pack 2020 during charging and ensures that all cells are evenly charged. The battery management 2018 systems keeps track of the battery voltage and disables the exercise device 102 if the battery is almost fully discharged, to protect the battery from permanent damage that may result from over discharging.

Figure 21A:
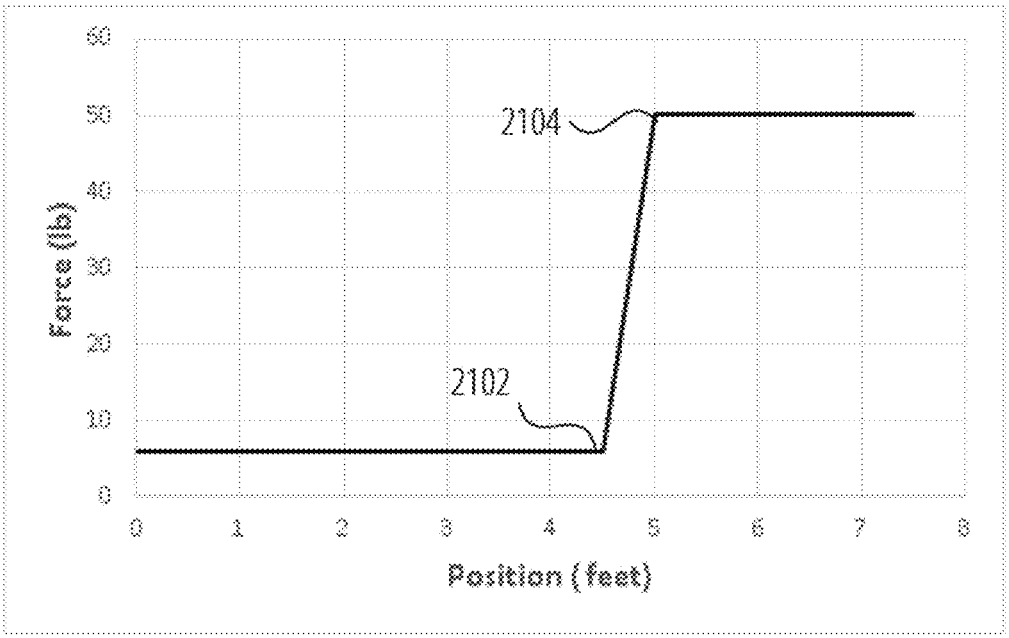
FIG. 21A is a graph that illustrates the relationship of the height of the bar or handle above the platform and the perceived weight experienced by the user, according to some examples.

The left encoder 2006 and the right encoder 2010 are each multi-turn type encoders that keep track of rotational position changes beyond 360 degrees and they are thus able to provide an output that is proportional to length of unspooled cable 202 outwards on both sides of the exercise device 102. This permits measurement of the height of the bar 116 or handle 114 above the platform 106. When using a traditional barbell, for exercises like an overhead press, the user needs to first place the barbell on the studs of a squat rack at a certain height and has to load the weights onto the barbell before the exercise can be performed. This ensures the force start point is set at the certain height above the floor and the exercise is always performed at a height above this start point. The user can also easily return the barbell to the squat rack at end of the exercise or during the exercise if they are struggling, without risking injury. But it can still be risky or inconvenient, if the user lowers the bar below the height of the studs during the exercise FIG. 21A is a graph that illustrates the relationship of the height of the bar 116 or handle 114 above the platform and the perceived weight experienced by the user, according to some examples. Since the position or height of the bar 116 or handle 114 above the platform 412 is known by the exercise device 102, a preset force-start start point 2102 at certain height above the platform can be set so that the tension in the cables 202 stays close to zero when the bar 116 or handle 114 is under the force-start start point 2102. This enables a user to pick up and lift the bar 116 or handles 114 easily and safely at a small nominal tension in the cables until the designated point at which the tension in the cable increases to the required level. The increase in the tension in the cables 202 to the required level occurs linearly over a short distance to avoid a sudden increase in the forces experienced by the user, until it reaches the full weight point 2104 of the exercise. If any time the user lowers the bar 116 or handles below the start point 2102, the tension in the cable returns to the small nominal tension, reducing or eliminating the risk of the user getting hurt if they are struggling to maintain the forces need to perform the exercise. This makes the exercise device 102 safer than a barbell picked up from studs on a squat rack.

The height of the force start point 2102 point can be specified for different exercises and for different users. It may be set to immediately above the shoulders for overhead-press as shown in FIG. 3C. For bicep curls, as shown in FIG. 3A, the force-start point height may be set aligned with mid thighs. For bent-over-rows, the force-start point height maybe set aligned with the knees. For deadlifts, it may be aligned to the lowest height that a user can comfortably lean based on their mobility and flexibility. This feature eliminates the requirement for a bulky squat rack while providing a safe exercise environment while doing workouts typically associated with free weights. The force-start point for every exercise along with the designated weight or force level can be stored for future use or entered before the exercise. In some cases, the user can enter their height and optionally their gender in an associated device such as a smartphone, the exercise device 102 or the associated device can calculate force-start points heights for various different exercises based on the user's height and known body proportions. The user can also directly specify start point heights or fine-tune start-point heights that have been estimated from the user's height, based on user preferences.

The left encoder 2006 and right encoders 2010 also permit the speed of each threaded spool 610 to be monitored. If the user ever drops a bar 116 during an exercise, the bar 116 will accelerate under the effects of tension in the cables 202 force and gravity on the bar 116, with a corresponding rapid increase in the speed of the motors 612. This is sensed by the encoders and in response to the embedded processor 2012 detecting that the speed of the cable or the speed of the motor 612 has exceeded a certain threshold, the embedded processor 2012 triggers a safety feature to cut the current to the motors 612 and thus releases the tension in the cables 202.

The height of the bar 116 or cable 202 can also be used to release the tension in the cable 202 if height thresholds are triggered before the speed of the motor 612 has reached the speed threshold. For example, if a start-point height has been set, the tension in the cables will revert to the small nominal tension if the bar 116 or handle 114 goes below the start-point height. Furthermore, if the bar 116 or handle 114 is dropped from a low height above the platform 106, the tension in the cables will revert to the small nominal tension once a minimum height above the platform is reached as detected by an encoder. While the bar 116 or handle 114 will still continue to fall under the effect of gravity, the impact of the bar 116 or handle 114 when it lands will be much more benign compared to dropping a weighted barbell or dumbbell. Additionally, the bar 116 will hit the side pods 108 first before hitting the user's feet.

Figure 21B:
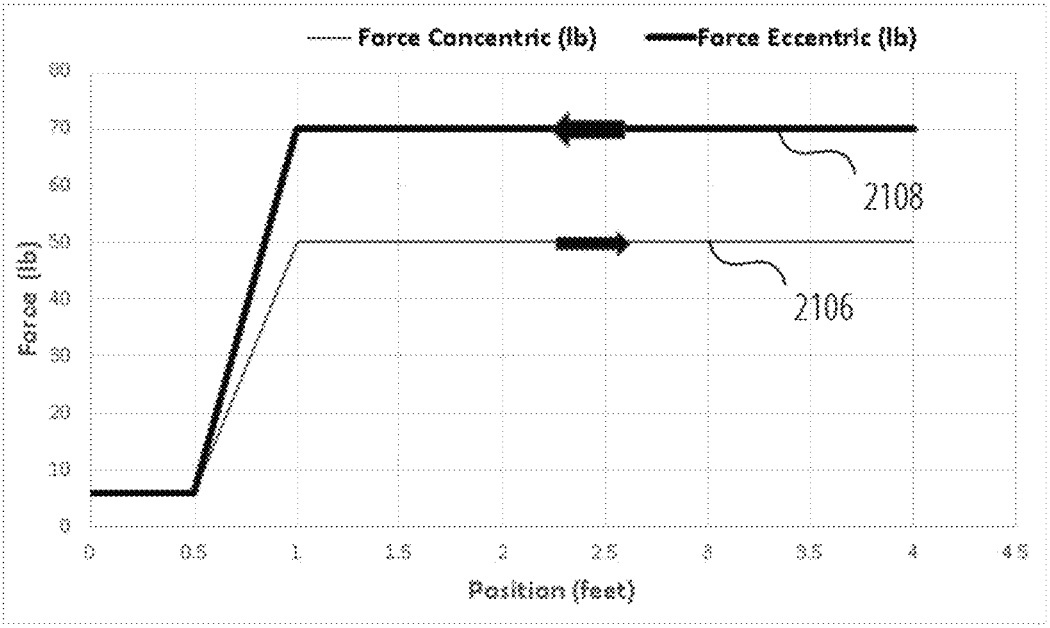
FIG. 21B is a graph that illustrates the perceived weight experienced by the user based on direction of motion of the cables, according to some examples.
Figure 21C:
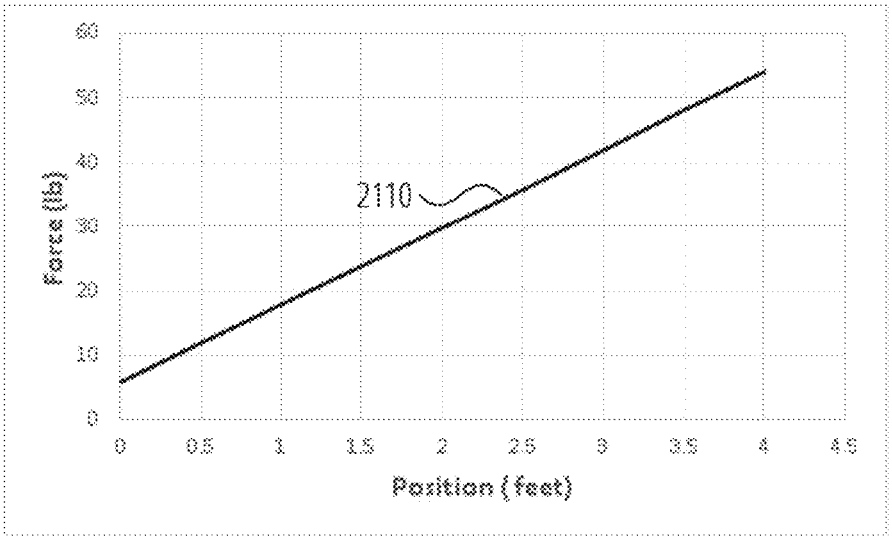
FIG. 21C is a graph that illustrates the perceived weight experienced by the user based on the range of motion of the cables 202 during an exercise, according to some examples.

FIG. 21B is a graph that illustrates the perceived weight experienced by the user based on direction of motion of the cables 202, according to some examples, while FIG. 21C is a graph that illustrates the perceived weight experienced by the user based on the range of motion of the cables 202 during an exercise, according to some examples.

It has been observed that strength of a user during an exercise is not fixed throughout the range of motion or the direction of motion. For example, while doing a deadlift, the strength of a user increases as the weight moves up in the range of motion. And the strength of a user is typically higher while lowering a weight (called the eccentric phase) compared to when they are lifting the weight (called the concentric phase). Hence, it may be beneficial to challenge the user by varying the tension in the cables 202 at different points in the user's range of motion (called accommodating resistance) or based on the direction of motion (called eccentric overloading) to match their strength curve.

Based on the outputs from the encoders, the tension in the cable can be varied by the embedded processor 2012. As shown in FIG. 21B, based on the encoders reporting that the cable 202 is being withdrawn, a first (lower) force level can be specified and controlled by the embedded processor 2012 for the concentric phase force 2106. Similarly, based on the encoders reporting that the cable 202 is being retracted, a second (higher) force level can be specified and controlled by the embedded processor 2012 for the eccentric phase force 2108. The direction of movement of the cable 202 can also be determined by the embedded processor 2012 encoder output detecting whether the encoder output is increasing or decreasing.

As shown in FIG. 21C, the embedded processor 2012 can also specify and control the tension in the cables to increase the force on the bar 116 or a handle as a cable 202 is being withdrawn from the side pods 108. In the figure, the relationship 2110 is shown to be a linear relationship between the height above the platform 106 and the force experienced by the user, but it will be appreciated that other relationships could be specified as needed or to match the strength curve of a user over the range of motion for a specific exercise.

With a traditional barbell, the user has to overcome the inertia of the barbell to move it from zero speed to a certain speed, hence the amount of force exerted by the user at beginning of a lift may be perceptibly higher than the weight of the barbell. As the barbell slows down at the end of the lift, the amount of force exerted by the user may be perceptibly lower than the weight of the barbell. Similarly, while changing direction during a curl or other exercise, the amount of force exerted by the user will be higher than the weight of the barbell at the bottom of the motion and lower at the top of the motion. While lowering the weight, if the user lowers the weight rapidly, the perceived force will be lot lower than the gravitational weight. This is known as the inertia effect.

Users are often advised to lift weights slowly and lower them very slowly. This makes sure the amount of force exerted by the user stays uniform throughout the range of motion and during the concentric and eccentric phases. However, in some power lifting exercises such as snatch, clean and jerk, the momentum of the barbell is utilized to perform the exercise. These dynamic movements are for advanced users and can be hurtful if not done properly, due to sudden changes in amount of force exerted by the user.

Since the exercise device 102 is able to measure the speed of the motors 612, the embedded processor 2012 can include a program or setting that increases or decreases the force in the cables dynamically as the speed of movement of the cable 202 increases or decreases. This feature allows the exercise device 102 to simulate the inertia effect. The amount and the rate at which the inertia effect is simulated can also be set or modified by the user.

If the inertia effect is not being simulated, an advantage of the exercise device 102 over free weights is that that no matter how fast a user lifts or lowers the bar 116, the amount of force experienced by the user can be controlled by the embedded processor 2012 to be uniform or to vary uniformly as discussed above. This ensures the amount of force experienced by the user does not change suddenly or unexpectedly, providing additional safety benefits.

It has also been observed that strength of a user may vary from day to day due to various circumstances. The strength of a user may also decrease over the course of a session. The exercise device 102 can capture metrics relating to the time of repetitions and/or the times or speeds of concentric and eccentric phases. Based on a certain change in the time or speed of one or more repetitions or phases from an average determined over the course of a session, or from previous sessions, the embedded processor 2012 can reduce the designated force profile for a particular exercise as the user's strength seems to drop, or increase the designated force profile for the exercise if the user's strength seems to have increased. This may reduce the need for the user to manually designate the level of a force profile at beginning of every exercise session, although it is always possible to set the level of resistance if desired. Such a features makes the process very time-efficient and frees the user from the burden of deciding how much to lift, The platform 106 may also have a plurality (four in some examples) of electrode sensors and/or a dedicated retractable hand bar may include a plurality of electrode sensors in addition to or instead of sensors in the platform 106. These electrodes send very tiny amounts of current up through one leg and down through other leg, or through the user's hands in the hand-held sensors, to be able to estimate body composition (percentage of bone, muscle, subcutaneous and visceral fat) as well as to estimate the heart rate of the user. Such information about the body observed over time and alongside the exercise data can be used to track the progress and wellness of the user.

Figure 22:
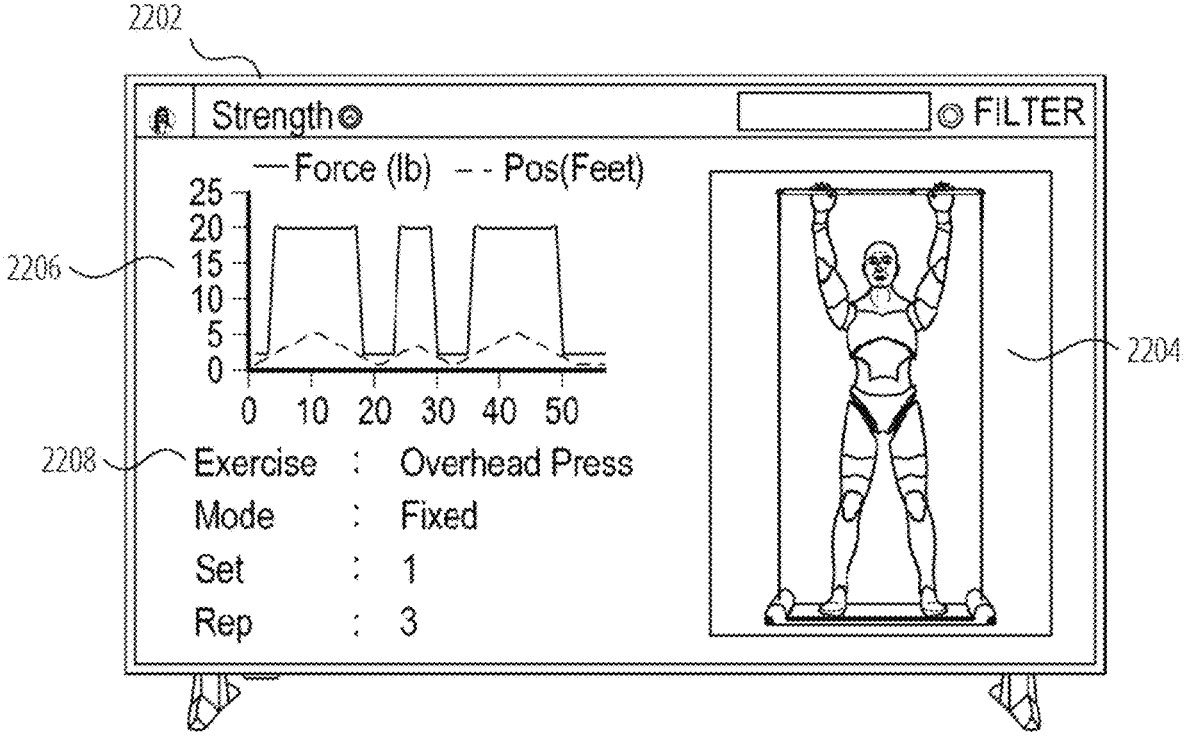
FIG. 22 illustrates a display that may be shown on a related display device during use of the exercise device, according to some examples.
Figure 23:
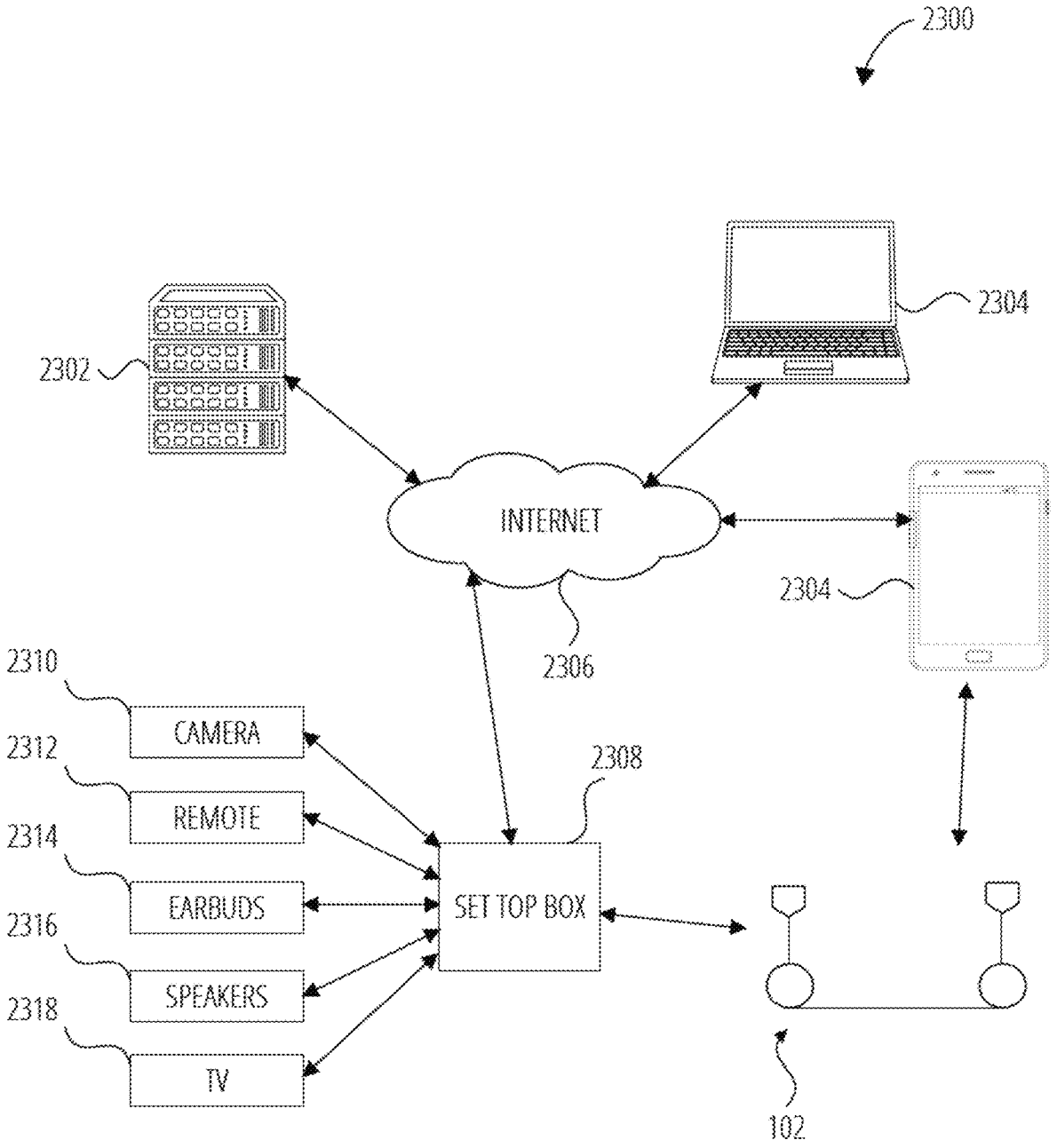
FIG. 23 illustrates a system including an exercise device, a server, and various client devices according to some examples.

FIG. 22 illustrates a display that may be shown on a related display device 2202 during use of the exercise device 102, according to some examples. The display includes a window with a video feed 2204 from a camera located in or on the display device 2202 and pointed at the user, so that they can monitor their form during the exercise. Alternatively, an instructor or avatar can be shown instead, to provide guidance to the user. The display also includes a chart 2206 showing the height of the bar 116 over time, as well as a display of the force applied to the bar over time. The display also includes a status display 2208 that shows the selected exercise, the exercise mode (such as fixed force or height or speed adaptive), the number of sets of the exercise that have been done in the current session, and the number of repetitions done in the current set of the exercise FIG. 23 illustrates a system 2300 including an exercise device 102, a server 2302, and client devices 2304 according to some examples. In various examples, the client devices 2304 may include desktop PCs, mobile phones, laptops, tablets, wearable computers, smart televisions or other computing devices that are capable of connecting to the Internet 2306 and communicating with the server 2302, such as described herein. The client device 2304 may be paired with the exercise device 102 using a Bluetooth connection, to provide a user interface by means of which a user of the exercise device 102 can manage the exercise device 102, as well as to receive feedback on their use of the exercise device 102.

A mobile phone or a tablet computer may be a suitable client device 2304 for use with the exercise device 102, since these devices have a touch screen for display and user input, a Bluetooth adapter for communication with the exercise device 102, a Wi-Fi adapter for connection to the Internet 2306, and a camera and microphone for video communication. An application running on a mobile phone or tablet computer can thus do all the data processing, relaying of logged data to the server 2302, as well as streaming of video or other audio content from the internet, and communicating with the users of other exercise devices 102 or with remote personal trainers. Such an application can also be used to control the exercise device 102 to select exercise types and levels, select different user profiles for the exercise device 102, and track and display information about the user's current session and overall progress as shown in FIG. 22.

Another suitable device for use with the exercise device 102 is a set top box 2308 with an associated television 2318 or monitor. The set top box 2308 is a smart, internet-connected device with an inbuilt computer capable of running an application to provide the capabilities described above with reference to the client device 2304. Some examples of such a set-top box are Amazon Fire TV cube, Amazon fire TV stick, Google Chromecast TV, and so forth. The television 2318 may also be a smart television that has set top box functionality built in, in which case a separate set top box 2308 may not be required.

The set top box 2308 provides a video signal to the TV over HDMI or other display protocol. The set top box 2308 and/or a smart television 2318 may be preferred over a smartphone or a tablet because they can be controlled by a remote control 2312 that can be used from a distance, provide a larger display, and may be easier to use, especially for the elderly. Wireless connectivity like Bluetooth, Wi-Fi, etc. are typically available on current smart televisions or set-top boxes, or can be easily added via a USB interface. Such connections can again be used to exchange data between remote servers 2302, the exercise device 102 and to communicate with workout partners or personal trainers over the Internet 2306.

For video communication, a camera 2310 may be in-built into the set-top box 2308 or the television 2318 TV. Alternatively, a camera with a wired USB interface can be connected to a USB interface on the set-top set top box 2308 or smart television 2318. Audio output can be provided by earbuds 2314 connected to the set top box 2308 or the smart television 2318, or by wired or wireless speakers 2316. A microphone may be built into the camera, the set-top box, may be connected to the set-top box 2308 via USB, or be included in wireless earbuds connected through Bluetooth.

Figure 24:
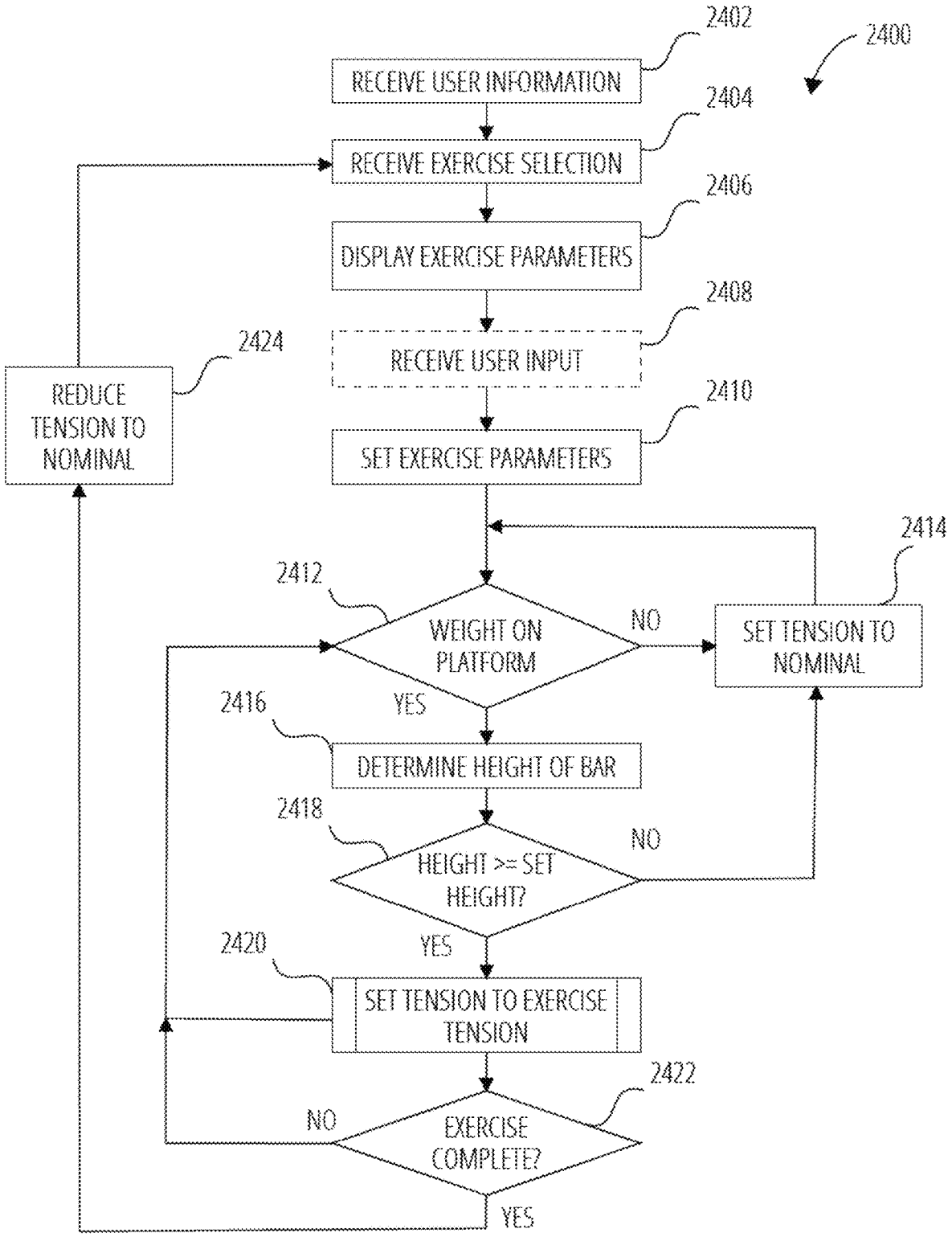
FIG. 24 illustrates a flowchart 2400 for generating resistance for an exercise session with the exercise device 102 according to some examples.

FIG. 24 illustrates a flowchart 2400 for providing an exercise session with the exercise device 102 according to some examples. For explanatory purposes, the operations of the flowchart 2400 are described herein as occurring in serial, or linearly. However, multiple operations of the flowchart 2400 may occur in parallel. In addition, the operations of the flowchart 2400 need not be performed in the order shown and/or one or more blocks of the flowchart 2400 need not be performed and/or can be replaced by other operations. Also provided is a non-transitory computer-readable storage medium, the computer-readable storage medium including instructions that when executed by a computer, cause the computer to perform one or more of the operations in flowchart 2400.

The method may execute for example on a combination of the exercise device 102 and an application running on a client device 2304 with which the exercise device 102 is paired, although many variations are possible, including running entirely on the exercise device 102 or with some of the method steps being performed on, or associated data being retrieved from, a remote location such as a server 2302. For the purposes of describing the flowchart 2400, the exercise device 102 and any associated devices that may be involved in the method are referred to as "the system." Additionally, the flowchart 2400 is described herein with reference to the tension in the cables 202 when the exercise is being performed with a bar 116. It will be appreciated that the flowchart applies equally to the tension in a cable 202 if an exercise is performed with a handle 114.

The method begins at operation 2402 with the receipt by the system of user information. This could be input directly by the user (e.g. height and gender), or could be retrieved or provided automatically based on a user profile, or could be set initially to the information from the user when they last used the exercise device.

In operation 2404, the system receives user selection of a particular exercise to perform with the exercise device 102, and displays corresponding exercise parameters to the user based on the type of exercise and the user information received in 2406. The parameters may include number of reps, number of sets, weight or to be applied to the bar 116 (or one or both handles 114), the height above the platform 106 at which the weight or force is to be applied, whether the force varies during the exercise as described with reference to FIG. 25, and so forth. The user may then specify or amend the exercise parameters in operation 2408. The system then sets the exercise parameters in operation 2410 based on either the original parameters from operation 2406 or as set or modified by the user in operation 2408

In operation 2412 the system determines whether there is weight on the platform. This can be a binary indicator from one or more depressed wheels 110, or based on other sensors, for example in the platform 106 or the chassis 104. If there is no weight on the platform 106 then the tension in the cables 202 is set to a small nominal value in operation 2414 (if the tension is not already at that value) and the method returns to operation 2412. If there is weight on the platform, the method proceeds to operation 2416 where the height of the bar 116 (or a handle 114) above the platform 106 is determined. This may not actually be the height of the bar 116 above the platform 106, but it may be a related parameter such as the number of turns and rotational position of one or both threaded spools 610 as reported by the encoders 1910.

In operation 2418 the system determines whether the height of the bar is at or above the set height. If the bar is not at or above the set height, the tension in the cables 202 is set to a small nominal value in operation 2412 (if the tension is not already at that value) and the method returns to operation 2412. If the height above the bar is greater than or equal to the set height, the tension in the corresponding cable 202 is set to the exercise tension in subroutine 2420, corresponding to the weight for the exercise as specified in operation 2410. If the tension had been the nominal tension from operation 2414, the tension can be increased over a short period of time or a short distance as described previously. Subroutine 2420 is described in more detail in FIG. 25.

The system then determines in 2422 if the exercise is complete, for example by counting the number of reps. If the exercise is complete, the tension in the cables 202 is reduced to the nominal tension in operation 2424 and the method returns to operation 2404 and proceeds from there. If the exercise is not complete, the method returns to operation 2412 and proceeds from there.

Figure 25:
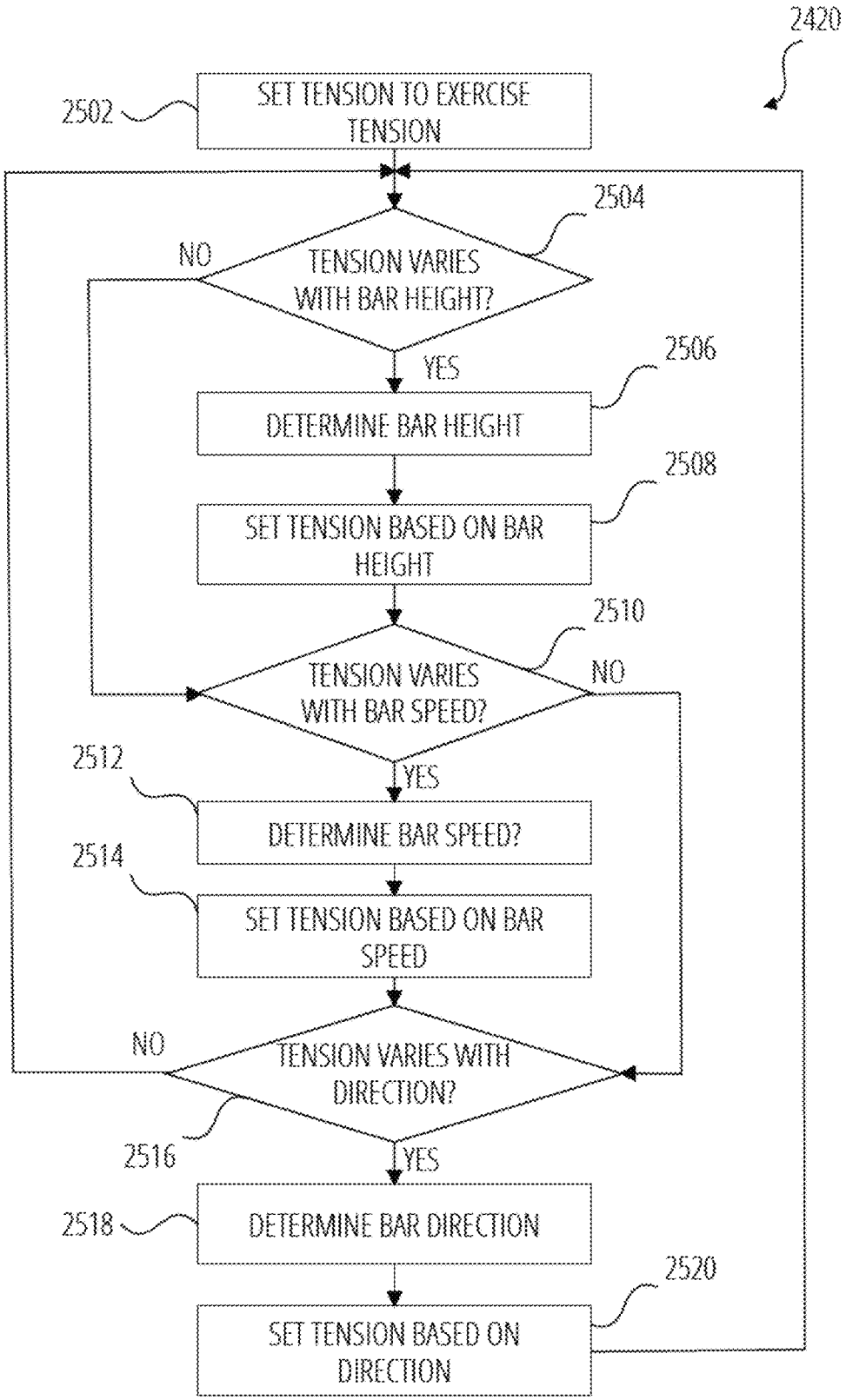
FIG. 25 illustrates a flowchart corresponding to a subroutine of FIG. 24 according to some examples.

FIG. 25 illustrates a flowchart corresponding to the subroutine 2420 of FIG. 24 according to some examples. As the height of the bar 116 above the platform has been determined to be greater than or equal to the set height verified in operation 2418, the tension in the corresponding cable 202 is set initially to a start or basic value of the exercise tension in operation 2502, corresponding to the start or basic weight for the exercise as specified in operation 2410. In operation 2504 the system performs a check to see if the tension in the cables 202 varies with the height of the bar above the set height. If it does, the system determines the height of the bar in operation 2506 and sets the tension in the cables 202 based on bar height in operation 2508. If the tension does not vary with bar height, the method continues at operation 2510.

In operation 2510 the system performs a check to see if the tension in the cables 202 varies with the speed of movement of the bar 116. If it does, the system determines the speed of the bar 116 is in operation 2512, and sets the tension in the cables 202 based on bar speed in operation 2514. If the tension does not vary with bar speed, the method continues at operation 2516.

In operation 2516 the system performs a check to see if the tension in the cables 202 varies with the direction of motion of the bar 116. If the tension does not vary with bar direction, the method continues at operation 2504. If the tension does vary with bar direction, the system determines the direction of the motion of the bar 116 in operation 2518 and sets the tension in the cables based on bar height in operation 2520. The method then continues at operation 2504.

As referred to herein, the term non-transitory machine-readable medium refers to a single or multiple storage devices and/or media (e.g., a centralized or distributed database, and/or associated caches and servers) that store executable instructions and/or data. The terms shall accordingly be taken to include, but not be limited to, solid-state memories, and optical and magnetic media, including memory internal or external to processors. Specific examples of machine-storage media, computer-storage media and/or device-storage media include non-volatile memory, including by way of example semiconductor memory devices, e.g., erasable programmable read-only memory (EPROM), electrically erasable programmable read-only memory (EEPROM), FPGA, and flash memory devices (external or internal to processor); magnetic disks such as internal hard disks and removable disks; magneto-optical disks; and CD-ROM and DVD-ROM disks.

Changes and modifications may be made to the disclosed examples without departing from the scope of the present disclosure. These and other changes or modifications are intended to be included within the scope of the present disclosure, as expressed in the following claims as filed or amended.

What is claimed is:

1. An exercise device, comprising:

a base having a first side and a second side;

a first retraction mechanism located at or near the first side;

a first cable guide located at or near the second side;

a first cable passing between the first retraction mechanism and the first cable guide and being attachable to a workout element;

a second retraction mechanism located at or near the second side;

a second cable guide located at or near the first side; and a second cable passing between the second retraction mechanism and the second cable guide and being attachable to a workout element, wherein the first retraction mechanism comprises a first motor and a first elongated spool coupled to the first motor, onto which the first cable is wound and unwound in use, and wherein the second retraction mechanism comprises a second motor and a second elongated spool coupled to the second motor, onto which the second cable is wound and unwound in use.

2. The exercise device of claim 1, wherein the first elongated spool has a length that is at least five times a diameter of the first elongated spool and wherein the second elongated spool has a length that is at least five times a diameter of the second elongated spool.

3. The exercise device of claim 2, further comprising:

a rotational encoder coupled to the first motor to provide an output representing rotation of a shaft of the first motor.

4. The exercise device of claim 3, wherein the rotational encoder is a multi-turn encoder.

5. The exercise device of claim 4, further comprising:

a control processor for controlling operation of the first motor and the second motor; and one or more current sensors for each of the first motor and the second motor;

wherein, in use, tension generated in the first cable and the second cable is controlled by the control processor based on current levels detected by the one or more current sensors.

6. The exercise device of claim 2, wherein the first motor drives the first elongated spool directly and wherein the second motor drives the second elongated spool directly.

7. The exercise device of claim 6, wherein the first side and the second side are raised to enclose the first retraction mechanism and the second retraction mechanism respectively, and the base comprises a low platform between the first side and the second side.

8. The exercise device of claim 7, wherein the first cable and the second cable cross under the platform.

9. The exercise device of claim 6, wherein an axis of rotation of the first motor and first spool is arranged in a front-rear direction of the exercise device and an axis of rotation of the second motor and second spool is arranged in a front-rear direction of the exercise device.

10. The exercise device of claim 2, wherein the first motor is a low inertia motor.

11. The exercise device of claim 10, wherein the first motor is an inrunner motor.

12. The exercise device of claim 10, wherein the first motor is a pseudo-stacked PCB stator axial flux motor.

13. The exercise device of claim 1, further comprising:

at least one wheel coupled to the base, the at least one wheel being movable between an extended position and a retracted position;

at least one sensor operatively associated with the at least one wheel, the at least one sensor providing two outputs corresponding respectively to the extended position and the retracted position; and logic to disable and enable functioning of the first retraction mechanism and the second retraction mechanism based on the two outputs from the at least one sensor.

14. The exercise device of claim 1, wherein the first retraction mechanism comprises the first motor and the second retraction mechanism comprises the second motor, the exercise device further comprising:

a first sensor providing an output based on an amount of extension of the first cable from the base;

a second sensor providing an output based on an amount of extension of the second cable from the base; and control logic coupled to the first motor and the second motor, the control logic varying a torque of the first motor based on the output from the first sensor and varying a torque of the second motor based on the output from the second sensor.

15. The exercise device of claim 1, wherein the first side and the second side are raised to enclose the first retraction mechanism and the second retraction mechanism respectively, and the base comprises a low platform between the first side and the second side.

16. The exercise device of claim 15 wherein the first cable and the second cable cross under the platform.

17. The exercise device of claim 1, wherein the base comprises a platform between the first side and the second side, the exercise device further comprising a first exercise bar holder at the first side and a second exercise bar holder at the second side, configured to retain an exercise bar above the platform.

18. The exercise device of claim 17, wherein the first exercise bar holder and second exercise bar holder are each rotatable from an upright position into a position adjacent to a side of the exercise device.

19. The exercise device of claim 1, wherein the first elongated spool has a length that is at no less than twice a diameter of the first elongated spool and wherein the second elongated spool has a length that is no less than twice a diameter of the second elongated spool.

20. The exercise device of claim 1, wherein the first elongated spool has a length that is approximately ten times a diameter of the first elongated spool and wherein the second elongated spool has a length that is approximately ten times a diameter of the second elongated spool.

* * * * *